US005672187A

United States Patent [19]

Rock et al.

[11] Patent Number: 5,672,187

[45] Date of Patent: *Sep. 30, 1997

[54] CYCLONE VORTEX SYSTEM AND PROCESS

[75] Inventors: Howard P. Rock; Kelly P. Rock, both of Salt Lake City, Utah; Grant R. Wood, Bellingham, Wash.

[73] Assignee: Cyclone Technologies Inc., Salt Lake City, Utah

[ * ] Notice: The term of this patent shall not extend beyond the expiration date of Pat. No. 5,512,216.

[21] Appl. No.: 639,153

[22] Filed: Apr. 29, 1996

Related U.S. Application Data

[63] Continuation-in-part of Ser. No. 461,444, Jun. 5, 1995, Pat. No. 5,512,216, which is a continuation of Ser. No. 346,257, Nov. 23, 1994, Pat. No. 5,472,645.

[51] Int. Cl.[6] ..... F02M 29/06

[52] U.S. Cl. ..... 55/257.4; 261/79.1

[58] Field of Search ..... 261/79.1, DIG. 21, 261/DIG. 55; 55/257.4

[56] References Cited

U.S. PATENT DOCUMENTS

| | | | |
|---|---|---|---|
| 860,259 | 7/1907 | Smith | 261/79.1 |
| 1,233,557 | 7/1917 | Curtis | 261/79.1 |
| 1,752,506 | 4/1930 | Portail | 261/79.1 |
| 1,773,477 | 8/1930 | Chisholm | 261/79.1 |
| 1,798,461 | 3/1931 | Fauser, Jr. | 261/79.1 |
| 2,282,225 | 5/1942 | Hawley | 261/79.2 |
| 3,053,238 | 9/1962 | Meurer | 261/79.1 |
| 3,233,879 | 2/1966 | Mitchell | 261/79.2 |
| 3,286,997 | 11/1966 | Ledbetter | 261/79.1 |
| 3,332,231 | 7/1967 | Walsh | 261/79.1 |
| 3,336,017 | 8/1967 | Kopa | 261/79.1 |
| 3,419,242 | 12/1968 | Bouteleux | 261/79.1 |
| 3,651,619 | 3/1972 | Miura | 261/79.2 |
| 3,667,221 | 6/1972 | Taylor | 261/79.1 |
| 3,944,634 | 3/1976 | Gerlach | 261/79.1 |
| 4,215,535 | 8/1980 | Lewis | 261/79.1 |
| 4,464,314 | 8/1984 | Surovikin et al. | 261/79.2 |
| 4,515,734 | 5/1985 | Rock et al. | 261/79.1 |
| 4,568,500 | 2/1986 | Rock et al. | 261/79.1 |
| 5,472,645 | 12/1995 | Rock et al. | 261/79.1 |
| 5,512,216 | 4/1996 | Rock et al. | 261/79.1 |

FOREIGN PATENT DOCUMENTS

| | | | |
|---|---|---|---|
| 746984 | 6/1933 | France | 261/79.1 |

*Primary Examiner*—Tim R. Miles
*Attorney, Agent, or Firm*—McDermott, Will & Emery

[57] ABSTRACT

This invention relates to a system and process for fuel or liquid preparation including a plurality of vortex stacks of sequential vortex elements based on fuel or liquid inputs or conditions operationally coupled with an integrated pre-manifold centrifuge type-cyclone scrubber. Each vortex stack comprises a base vortex element followed by varying arrangements of air-accelerator vortex elements. The fuel enters the base vortex element creating a vortical (spinning) column, which is enhanced and accelerated by transonic-sonic velocity air inflows in the accelerator vortex elements. Entrained fuel aerosol droplets are sheared and turbulently reduced by pressure differentials into a viscous vapor phase, and then into a gas-phase state. The vortical column containing turbulently vaporized fuel and any residual aerosols in the air mixture then passed into and through a venturi. Then, the fluid flow may go through to a fuel scrubbing and mixing section where any collected aerosols are returned as liquid to the stacks and re-processed. This allows only the vaporized, homogenized and usually chemically stoichiometric, or leaner, (oxygen balanced) and combustion ready gas-phase fuel to exit the system.

79 Claims, 12 Drawing Sheets

CYCLONE VORTEX SYSTEM AND PROCESS

This is a continuation-in-part of application Ser. No. 08/461,444, filed Jun. 5, 1995, now U.S. Pat. No. 5,512,216, issued Apr. 30, 1996, which is a continuation of application Ser. No. 08/346,257, filed Nov. 23, 1994, now U.S. Pat. No. 5,472,645, issued Dec. 5, 1995.

BACKGROUND OF THE INVENTION

The present invention is directed broadly to an improved fluid vaporizing apparatus and method for producing a gas-phase mixture.

The present invention is directed more specifically to an improved fuel vaporizing system and associated process for producing a vaporized chemically-stoichiometric gas-phase fuel-air mixture for use in internal combustion engines and for external combustion burners.

In the context of this document the terms "Vaporize", "Vaporizing", "Vaporized", or any derivative thereof means to convert a liquid from an aerosol or vapor-phase to a gas-phase by means of vorticular turbulence where a high velocity low pressure-high vacuum condition exists, i.e., differential pressures exist.

Internal combustion engines (both diesel and otto-cycle gasoline) currently employ various systems for supplying a fuel aerosol of liquid fuel droplets and air, either directly into the diesel engine combustion chamber where compression heat ignites the fuel-air mixture or with a carburetor or fuel injection device(s) through an intake manifold into an otto-cycle engine combustion chamber where an electric spark ignites the mixture of air and fuel vapor, which is produced as the smaller aerosol droplets evaporate-vaporize. In all currently employed systems, this fuel-air mixture is produced by atomizing a liquid fuel and supplying it as a fuel aerosol into an air stream. But, in order for fuel oxidation within the combustion chamber to be chemically complete, the fuel-air aerosol must be vaporized to a chemically-stoichiometric gas-phase mixture. Stoichiometricity is a condition where the amount of oxygen required to completely burn a given amount of fuel is supplied in a homogeneous mixture resulting in optimally correct combustion, with no residues remaining from incomplete or inefficient oxidation. Ideally, the fuel aerosol should be completely vaporized, intermixed with air and homogenized PRIOR to entering the combustion chamber. Aerosol fuel droplets do not ignite and combust completely in any current type of internal or external combustion engine or device.

As a result, unburned fuel residues are exhausted from the engine (device) as pollutants such as unburned hydrocarbons (UHC), carbon monoxide (CO), and aldehydes, with concomitant production of oxides of nitrogen (NOx). These residues, require further treatment in a catalytic converter(s) or scrubber(s) to meet current emission standards and result in additional fuel costs to operate the catalytic system(s) converter(s) or scrubber(s). A significant reduction in any or all of these pollutants and the required control hardware would be highly beneficial, both economically and environmentally.

Moreover, a fuel-air mixture that is not completely vaporized and chemically-stoichiometric results in incomplete combustion, causing the internal combustion engine to perform inefficiently. Since a smaller portion of the fuel's chemical energy is converted to mechanical energy, fuel energy is wasted thereby generating unnecessary heat and pollution.

The mandate to reduce air pollution has necessitated attempts to correct or compensate for combustion inefficiencies with a multiplicity of fuel system and internal-engine modifications and also add-ons. These various external control devices are all intended to more completely vaporize-homogenize fuel-air mixtures. As evidenced in the prior art concerning fuel preparation systems, much effort has been expended to reduce the aerosol droplet size and increase system turbulence while providing sufficient heat and enough residence time to evaporate-vaporize the fuels to allow complete combustion. However, the achievement of total aerosol vaporization has proven difficult because current liquid hydrocarbon fuels, such as gasoline, are mixtures composed of numerous "tray fractions" from the oil refinery fractionating tower. The lighter and more volatile fuel fractions vaporize and combust when the fuel is subjected to combustion heat with in-cylinder heat-turbulation. Heavier and less volatile components require additional kinetic energy and cylinder residence time to obtain sufficient molecular agitation and particle size-weight reduction for vaporization. As evidenced by the present internal combustion engine pollution emissions, these problems have been moderated but never solved.

As paradoxical as it may seem, the present problems of engine inefficiency and resultant harmful emissions exist because of a "misdirection" or "mistake" in the early days of combustion engine development. The first gasoline engines used a simple device that included a series of fuel saturated cloth wicks, or panels, through which the air was drawn into the intake manifold by engine vacuum. As the air moved past or through the wicks, the gasoline vapors were drawn into a high compression ratio engine cylinder(s). Combustion was then initiated by means of a very crude live flame or electric spark ignition system. This fuel-air mixture was in fact a very combustible and efficient vapor-phase. The problem developed because as the more volatile fuel molecules were removed from the gasoline, the fluid left behind in the tank became less and less volatile and heavier in specific gravity until the engine would not satisfactorily operate. This system left a troublesome, heavy, non-volatile, oily residue which was totally unsuitable as a spark ignition-otto-cycle engine fuel, and which then had to be drained from the fuel tank and discarded. When the tank was resupplied with fresh gasoline, the engine would again run and the process was started over.

The solution was ingeniously simple, BUT WRONG! It involved dripping, or spraying the fresh fuel taken from the bottom of the fuel tank into the engine inlet air stream, thus creating a FUEL AEROSOL MIXTURE, which could only be utilized in very low-compression ratio gasoline engines because of detonation problems. Continued aerosol fuel system developments produced the up-draft venturi otto-cycle type carburetion devices, which all functioned through pressure differentials within the unit. The diesel cycle compression ignition engine also produced an aerosol mist from the injectors. Next followed mechanical fuel pumps to feed down draft carburetors with single, then multiple throats, and more recently, the many variations and improved types of direct and indirect fuel injectors for both gasoline and diesel engines, which all produce fuel aerosols.

This sequential series of developments covers approximately 100 years, with every significant improvement directed at creating a more effective fuel aerosol. Today, both diesel injection and otto-cycle gasoline fuel systems continue to create at best inefficient fuel aerosols. These aerosols contain both gas vapor and liquid fuel droplets, which droplets generate power only if the droplets can be heat vaporized and burned during the combustion "cycle" time in the engine combustion chamber. Due to the carbon particulates resulting from this process, the combustion that occurs is termed "luminous flame combustion" and is incomplete. As a result, otto-cycle gasoline internal combustion engines utilizing aerosol fuel systems are severely limited by specific fuel combustion characteristics, fuel type and grades, and cannot employ high compression ratios (20:1 or above) because of detonation "knock." Moreover, this luminous flame combustion from aerosol fuels occurs above 2800° F. and inherently causes NOx (oxides of nitrogen) to form in both diesel and gasoline engines.

In hindsight, fuel system development over the last 100 years has followed an inefficient but effective path. High combustion temperatures and inefficient initial fuel preparation result in high amounts of emission pollutants, which then require some type of control elements. The control elements currently in use, in the form of exhaust gas recirculation, camshaft modifications, retarded timing, lowered compression ratios, catalytic converters, air injection reactors, etc. have all compounded engine inefficiency. Total and complete fuel vaporization would allow the actual achievement of chemically stoichiometric fuel oxidation to CO2 and H2O with the related pollution reductions. However, the current path being followed to solve the pollution-emissions problem appears to be directed at following the technologically difficult route(s) of specialized fuels, electric vehicles, exotic batteries, etc.

One solution to the above dilemma is the use of technology that actually does achieve stoichiometric fuel/oxidizer proportions as a combustion reality. The key is to reduce the fuel aerosol droplet size to the molecular level so that complete (or nearly complete) vaporization to the gas phase occurs within the existing time, temperature and turbulence constraints of the fuel preparation system PRIOR to fuel-air mixture entry into the combustion chamber.

There have been attempts in the prior art, which have relied on a turbulent circulation of the fuel-air mixture to separate the unvaporized portion of the fuel-air mixture from the vaporized portion and to provide only the vaporized portion of the fuel-air mixture to the intake manifold of an internal combustion engine.

For example, the separator patented by Edmonson, U.S. Pat. No. 1,036,812, uses a heated spiral-shaped conduit 9 to help volatilize the liquid hydrocarbon passing through the conduit. In addition, the conduit subjects the liquid hydrocarbon to centrifugal action to throw the heavier-unvolatilized hydrocarbon particles against a perforated plate 15 to break up the particles or to pass the heavier particles through perforations 16 and thereby return the heavier particles to the conduit.

A device disclosed by Cox in U.S. Pat. No. 2,633,836, is interposed between the intake manifold inlet and the carburetor outlet to both separate liquid fuel (in the form of suspended or entrained droplets), from the fuel-air mixture flowing from the carburetor and to vaporize a portion of the liquid fuel. The separating or further vaporizing functions are accomplished by passing the fuel-air mixture through spiral passages or conduits that divide the flow of the fuel-air mixture. The passages or conduits impart a centrifugal or swirling force on the fuel-air mixture, causing fuel droplets to be deposited on the side walls of the conduits/passages, from which walls the droplets are drained and returned to the fuel line.

Another device, in the form of a carburetor, was disclosed by Dempsey in U.S. Pat. No. 4,715,346. This carburetor includes three mixing chambers 12, 14, 16 arranged vertically in tandem. Gasoline spray and air enter the outer chamber of top chamber 12 through slot 60, flow spirally toward the central portion of the top chamber, enter the intermediate chamber 14 at its central portion, flow spirally outwardly toward the outer portion of the intermediate chamber, enter the bottom chamber 16 at its outer portion, flow spirally toward the central portion 90 of the bottom chamber and exit into the manifold of an engine. Heavy aerosol particles are separated from the fuel-air mixture at the central portion of the first chamber, collected in a reservoir 71, passed through a heater 104, and fed back into the fuel-air mixture at the center of the intermediate chamber 14.

These prior art devices and processes are ineffective to produce total vaporization of the fuel. Moreover, the prior art devices and processes do not produce a "complete" homogeneous intermixing of the fuel vapor with combustion air.

On the other hand, the device patented by Rock et al., U.S. Pat. Nos. 4,515,734 and 4,568,500 (the same inventors as the present invention) provides vaporized fuel to the intake manifold of an engine. Rock et al. described a series of mixing sites, including a venturi housing 172 for homogenizing and vaporizing fuel and air. The mixture passes tangentially into a fuel separating cyclone housing 190. In use, the fuel and air mixture entering the housing 190 circulates vortically at high speeds within an annular chamber 334. Any remaining non-vaporized or larger particles of fuel are impacted centrifugally against the interior surfaces of the walls 302 and 310, accumulated, and caused to flow by the force of gravity via a fuel return chute 336 to one of said mixing sites to be recycled into the venturi housing. A fully vaporized and homogeneous fuel-air mixture, absent any large particles of fuel, spills over the top edge 326 into the barrel 320 of the housing 190 and thence, into the intake manifold of an internal combustion engine. Essentially, only partially vaporized fuel reaches the cylinders of the engine.

The Rock et al. device provides important advantages in the operation of an internal combustion engine by cyclonically recycling non-vaporized particles of fuel, allowing almost total burning of all hydrocarbons in an associated engine. Nevertheless, there is a problem with the Rock et al. device in that the fuel-air mixture reaching the fuel-separating housing 190 contains too many non-vaporized particles of fuel, which should be recycled. The device only utilizes one mixing site to process the recycle fuel, which often leads to overloading the recycle system with resultant engine detonation from introducing aerosols into the engine combustion process. As a result, the device is not useful in an internal combustion engine having a compression ratio higher than standard production vehicles. It would be very advantageous if the device could be improved to provide a fuel-air mixture that is completely vaporized to a gas-phase prior to entering the housing 190.

SUMMARY OF THE INVENTION

In accordance with the present invention, an apparatus and process of fluid treatment are provided wherein middle cut distillate gasoline fuels and other industrial fluids of similar consistency are processed into an intermediate state as an aerosol and finally into the end product; a totally vaporized gas-phase fuel air mixture.

An object of this invention is to allow otto-cycle internal combustion engines to operate on a fuel-air mixture in the gas-phase state at the normal 8:1–9.5:1 compression ratios or at efficiency enhancing mechanically attainable compression ratios, i.e., 20:1 OR ABOVE and with significantly reduced emissions.

An additional object of this invention is to provide a sufficient number of differential pressure sites and conditions wherein under varying vacuum conditions the aerosol-air mixture is processed through a sequence of high velocity (small orifice)-high vacuum (larger chamber) conditions which will sequentially and systematically remove the largest (highest mass) fuel particles in each successive step reducing them to the previously mentioned gas-phase.

According to the invention, a cyclone vortex system (CVS) and method are disclosed for converting liquid hydrocarbon fuels to gas-phase fuel-air mixture having optimal combustion properties for internal combustion engines. The system is configured with separate functional sections, which process the fuel prior to entering the engine and combustion chamber. The system can be optimized for efficient operation at high compression ratios in an internal combustion engine, while keeping combustion temperatures below 2800° F.

The system is arranged in three distinct operating sections. The first section is a fuel vaporizing section that encompasses multiple vortex units arranged in series, which systematically vaporize the short chain and most of the long chain hydrocarbon and aromatic molecules. The second section is the main air section that includes an air intake and a butterfly throttle valve which controls the air flow rate into a venturi chamber through an annular mixing system, which assures even fuel density and enhanced pressure differentials within the vortex system. The third section is a fuel scrubbing section that includes a main cyclone or centrifugal chamber, where any remaining unvaporized fuel aerosol droplets are removed from the air stream and recycled back equally to the multiple vortex stack(s) for subsequent re-processing.

Liquid fuel aerosols and even gaseous fuels and air are moved turbulently at near sonic speed through a multiple vortex configuration comprising a series of vortex chambers, with each utilizing multiple zones of velocity and pressure differentials and finally through a larger cyclone or centrifuge which also serves as a significant pressure differential air-fluid mixing and liquid separation chamber. The vortex chambers break the liquid fuel down into an air-fluid stream of vaporized or gas-phase elements which may also contain some unvaporized aerosols, i.e., hydrocarbons of higher molecular weight. The process begins with the lighter fuel distillates or smaller particles being quickly vaporized to the gas-phase, homogeneously mixed with air prior to being fed to the combustion device. The heavier fuel portions (heavy ends) must also be transformed into a gas-phase-vaporized state before they can exit the cyclone vortex system (CVS) and enter the distribution or intake manifold of an engine.

In the preferred embodiment, the multiple vortex configuration includes one or more vortex stacks, each containing two or more vortex elements. The units of each stack are joined together in a tiered sequence to form a series of vortex turbulence and pressure differential chambers. A main flow path in the form of a column of fuel and air circulates at near sonic velocity within each of these chambers. Fresh fuel is metered to the vortex stack(s) by electronically controlled fuel injector(s). If the fuel is of such quality that recycle fuel is present, the vortex stack(s) operate on mixed fuel, which is a combination of fresh fuel and liquid recycle fuel that has separated or recondensed and been collected from the gas-phase and aerosol fuel-air mixture resulting from the first pass through the stacks and into the centrifuge scrubber cyclone mixing chamber.

Each vortex stack includes a tapered entry base vortex unit or flow pressure increasing duct having tangential aperture(s) in the rim or periphery thereof and also accelerator vortex units situated sequentially thereto. Each stack accelerator unit has air entry aperture(s) arranged tangentially to the main axial flow path. Air flow is introduced tangentially into the chambers of the base and accelerator vortex units to further enhance velocity and the shear forces acting upon, and in concert with the high axial speed and turbulent flow in the column of aerosol-fuel-air mixture to convert all the fuel aerosols in the mixture to a gas-phase. All of the gas-phase fluid containing unvaporized fuel aerosols from both vortex stacks is passed through a throttled venturi chamber, an annular spreader ring, which also enhances and stabilizes the stack vacuum, and thence on into the cyclone centrifuge-scrubber mixing chamber.

As the air-fuel gas-phase and fuel aerosol mixture enters the cyclone centrifuge chamber, centrifugal force, an air flow directional change, and a significant pressure differential slows the vortical speed but most importantly, in this reduced pressure zone allows any entrained unvaporized fuel aerosol particles either to completely disintegrate into the gas phase or impinge on the surfaces of the centrifuge chamber. This unvaporized fuel is collected into a floor channel in the centrifuge chamber as a liquid. The configuration of the chamber is significant in providing the air (oxygen) and fuel particles greater contact, or "loiter" time which assists in completing the gasification by using the sequential (repeated) pressure differential(s) found in the vortex, throttle body venturi and centrifuge chambers to increase the "mean free path" which the fuel-air mixture takes from initial mixing to combustion. The collected aerosols, or recycle liquid, is returned through the recycle path to the vortex stack(s) for reprocessing. Only a clean, gas-phase air-fuel mixture, free of all liquid or aerosol particles is introduced into the engine. In effect, only a vaporized, oxygen-balanced non-recondensible, chemically-stoichiometric, gas-phase, fuel-air mixture, enters the engine intake manifold.

Through this unique device and process, the cyclone vortex system provides important advantages. All fractions of the fuel are transformed into an ideally combustible, molecularly-oxygen balanced, stoichiometric gas phase state, before entering the engine. Unlike conventionally mixed air-aerosol fuels, the stoichiometric, (or leaner), gas-phase component burns to chemical completeness.

The in-cylinder combustion temperature of the gas-phase fuel-air mixture is below 2800° F. The low operating temperatures made possible by the cyclone vortex system precludes, for the most part, the creation of NOx (oxides of nitrogen). In essence, substantially all that remains to be exhausted from the engine and the combustion process is carbon dioxide and water. No carbonaceous deposits are left within the engine and only the so called "crevice emissions" are exhausted from the engine cylinder.

The cyclone vortex system has the benefit of providing for the efficient combustion of all appropriate fuels by vaporizing the fuel to a gas phase and combining the gas-phase fuel homogeneously with air prior to entry into the engine combustion chamber. The liquid fuel is transformed into a homogeneous mixture of gas-phased chemical hydrocarbon compounds that are stoichiometrically mixed with oxygen, and which results in improved distribution to the cylinders, and greatly improved combustibility.

The ability of the cyclone vortex system to eliminate the in-cylinder detonation potential of processed liquid-aerosols, and even gaseous hydrocarbon (propane, cryogenic or liquid natural gas, etc.) fuels is important since it allows compression ratios to be raised to the mechanical limits of the gasoline engine, which is often in the range of 22:1 but can be as high as 40:1.

It is now apparent that dramatically improved fuel economy with increased power and engine performance together with the elimination of most polluting emissions are the real demonstrated advantages of the cyclone vortex system (CVS). An additional advantage is that the CVS also allows the utilization of very high compression ratios for even greater efficiency.

The invention itself, together with further objects and attendant advantages, will best be understood by reference to the following detailed description, taken in conjunction with the accompanying drawings.

BRIEF DESCRIPTION OF THE DRAWINGS

FIG. 18(*b*) is a chart showing the heavier components in the recycle liquid.

DETAILED DESCRIPTION OF THE INVENTION

Like numerals are used to designate like parts throughout the drawings.

Figure 1:
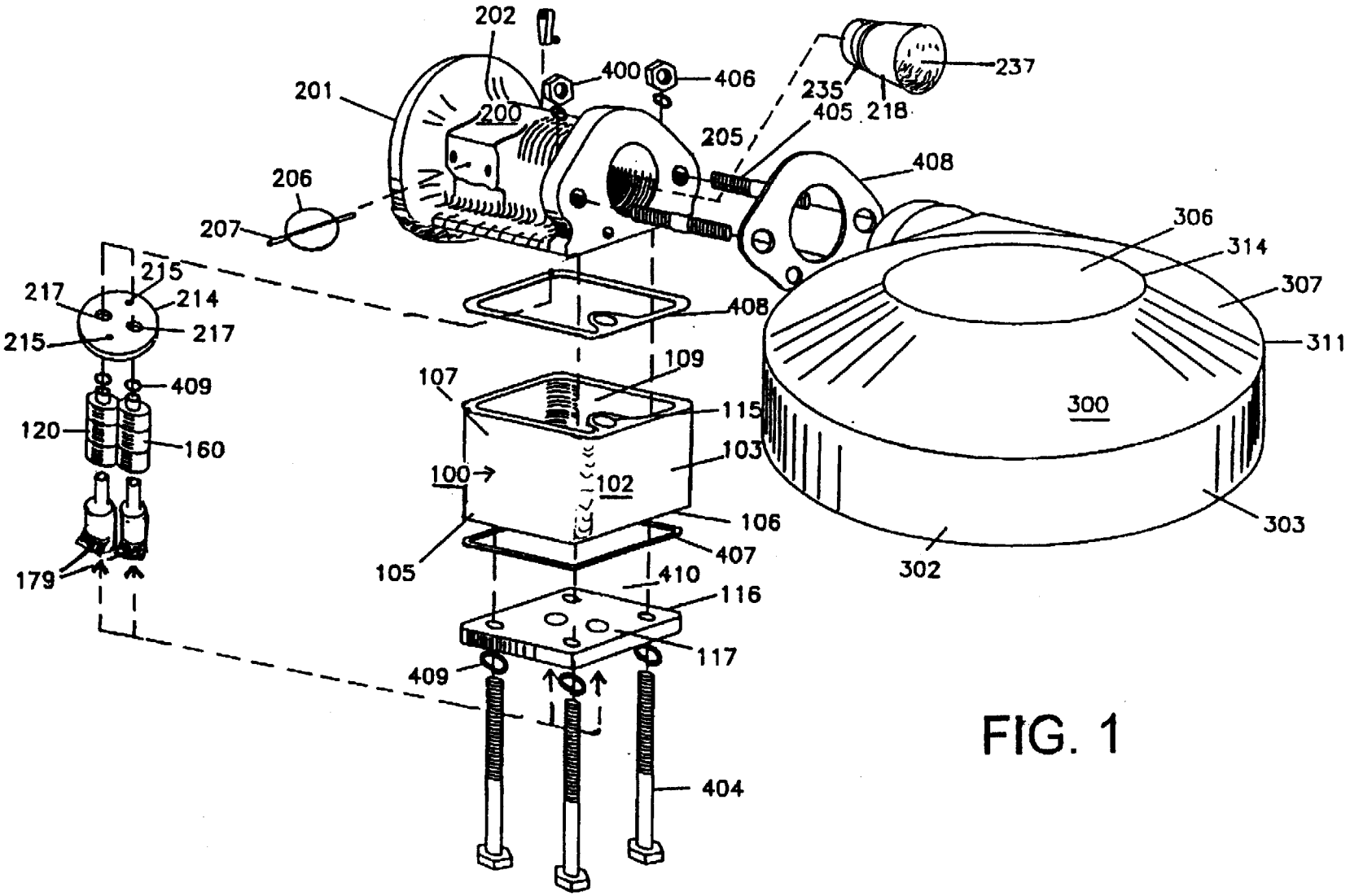
FIG. 1 is an exploded view of the cyclone vortex system.

Turning now to the drawings, FIG. 1 shows the preferred embodiment of the cyclone vortex system.

As shown in FIG. 1, the cyclone vortex system has three main sections: a fuel vaporizing section 100, a main air section 200, which includes a vacuum enhancing venturi-diffuser homogenizer, and a cyclone fuel scrubbing-mixing section 300. The fuel vaporizing section is shown in more detail in FIGS. 2–8. The main air section is shown in more detail in FIGS. 9–13. The cyclone fuel scrubbing, mixing section is shown in more detail in FIGS. 14–15.

The fuel vaporizing section is illustrated as comprising a lower hollow body portion, generally designated 102 (FIG. 1). The body portion is formed by four vertical side walls 103, and a bottom wall 106. A fuel recycle conduit 115 is formed on the inside of the outside wall 103.

A pair of vortex stacks 120 and 160 are situated within the air chamber 109 on the floor of the bottom wall 106. The vortex stack(s) 120 (FIG. 4) and 160 receive both fresh fuel and recycle fuel as operating conditions demand. The vortex stacks 120 and 160 (FIG. 1) are positioned in the bottom wall 106 (FIG. 4) over the recycle opening(s) 110 (FIG. 2) and the injector opening(s) 140 and 180 (FIG. 2) or first delivery inlets.

Figure 7:
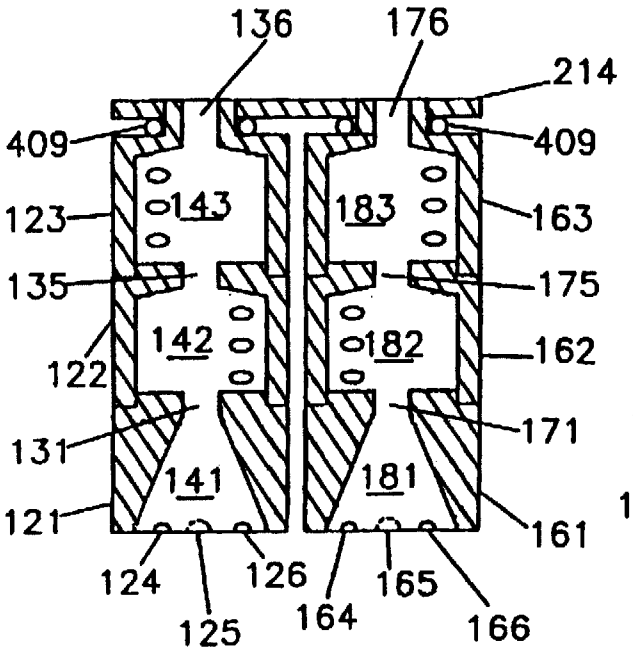
FIG. 7 is a cross-sectional view of the multiple element vortex stack configuration of the cyclone vortex system.
Figure 6:
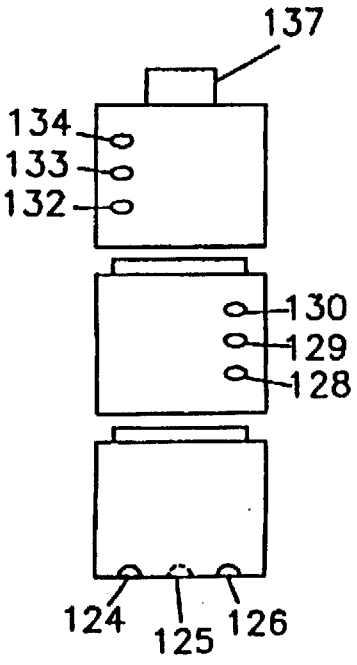
FIG. 6 is an exploded view of the multiple vortex configuration of a three-element stack in the cyclone vortex system.

Each vortex stack comprises two or more hollow-cylindrical tiered vortex stack elements identified as base vortex elements 121 and 161 (FIG. 8), intermediate accelerator vortex elements 122 and 162, and top accelerator vortex elements 123 and 163. The rim or edge 127 and 167 of each base vortex element 121 and 161 has one or a plurality of apertures or slots 124, 125 and 126 and 164, 165 and 166 and constricted bores 131 and 171 (FIG. 7). Each intermediate accelerator vortex element 122 and 162 has one or a plurality of apertures 128, 129 and 130 and 168, 169 and 170. Also, each intermediate accelerator vortex element 122 and 162 has a constricted bore 135 and 175 (FIG. 7). Each top accelerator vortex element 123 and 163 (FIG. 8) has one, or a plurality, of apertures 132–134 and 172–174. Also, each top accelerator vortex unit 123 and 163 (FIG. 8) has a constricted bore 136 and 176 (FIG. 7). Each vortex element 121–123 (FIG. 8) and 161–163 includes a vortex chamber (FIG. 7) 141, 142, 143, 181, 182 and 183. The aperture(s) or slots 124, 125, 126 and 164, 165 and 166 for the base vortex elements 121 and 161 (FIG. 8) are spaced symmetrically, if more than one, in the rim 127 and 167 around the axis thereof. The respective apertures, if more than one, (FIG. 8) 128–130, 132–134, 168–170 and 172–174 for the intermediate accelerator vortex element(s) 122 and 162 and the top accelerator vortex elements 123 and 163 are spaced symmetrically along the longitudinal axis of the respective vortex elements 122 and 123.

Figure 2:
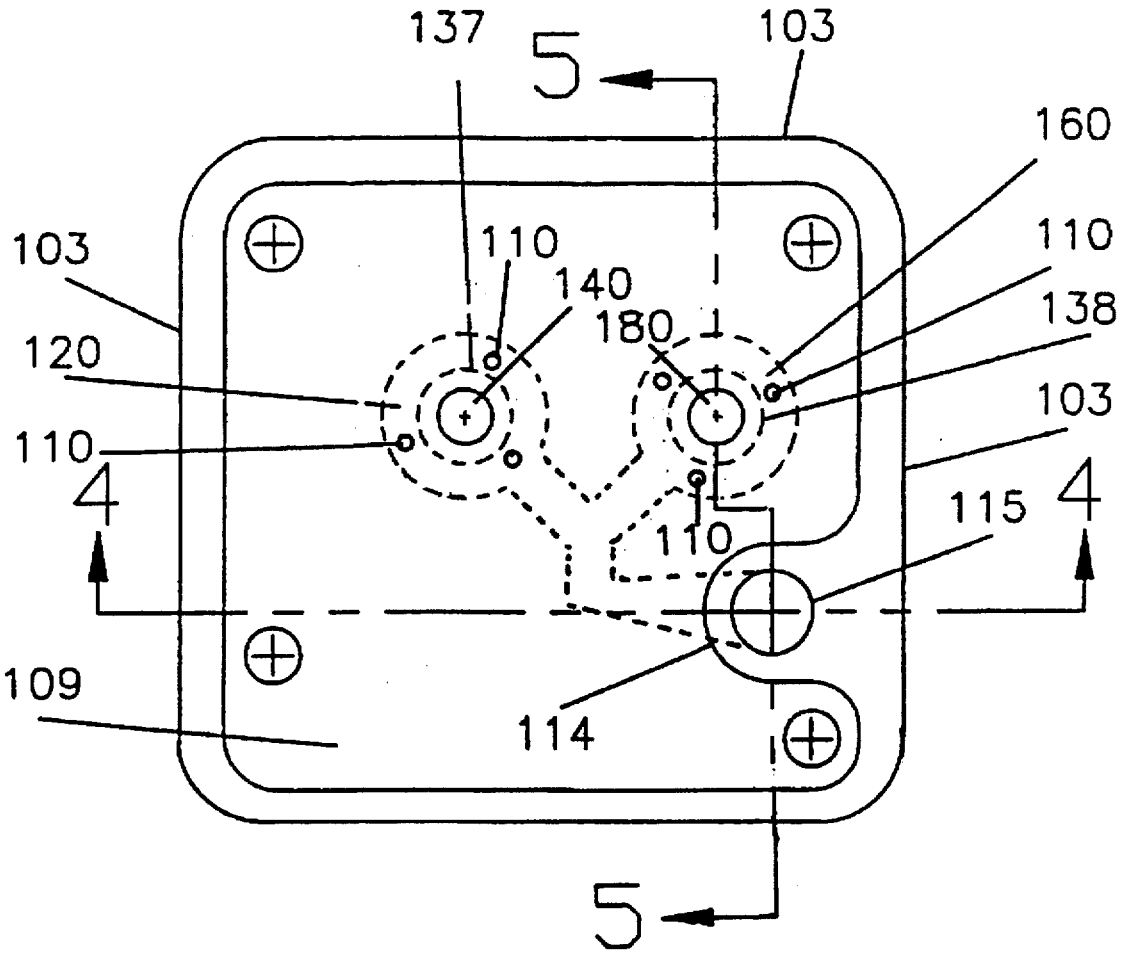
FIG. 2 is a top view of the hollow-body portion of the fuel vaporizing section of the cyclone vortex system.
Figure 3A:
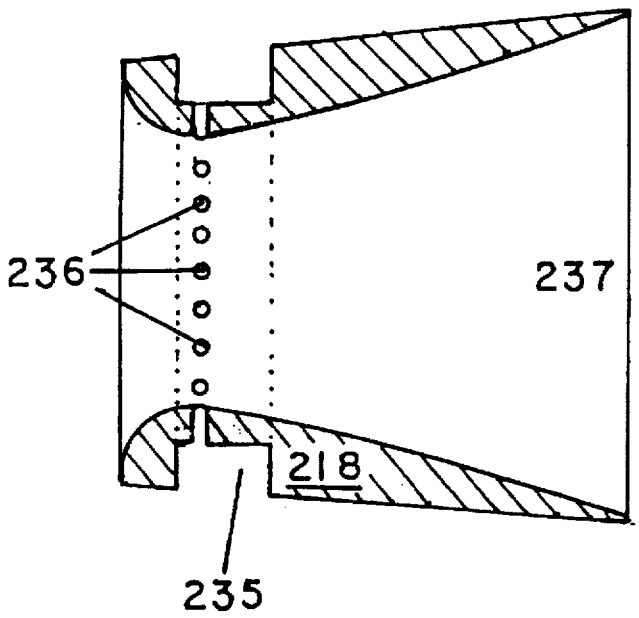
FIGS. 3A and 3B show a cross-section of the hollow-body venturi portion of the vacuum enhancing spreader ring-fuel air homogenizer and an end view of the same, respectively.
Figure 3B:
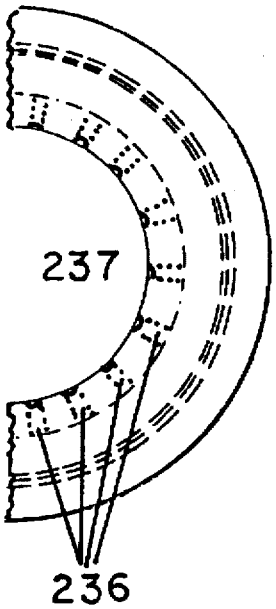
Figure 4:
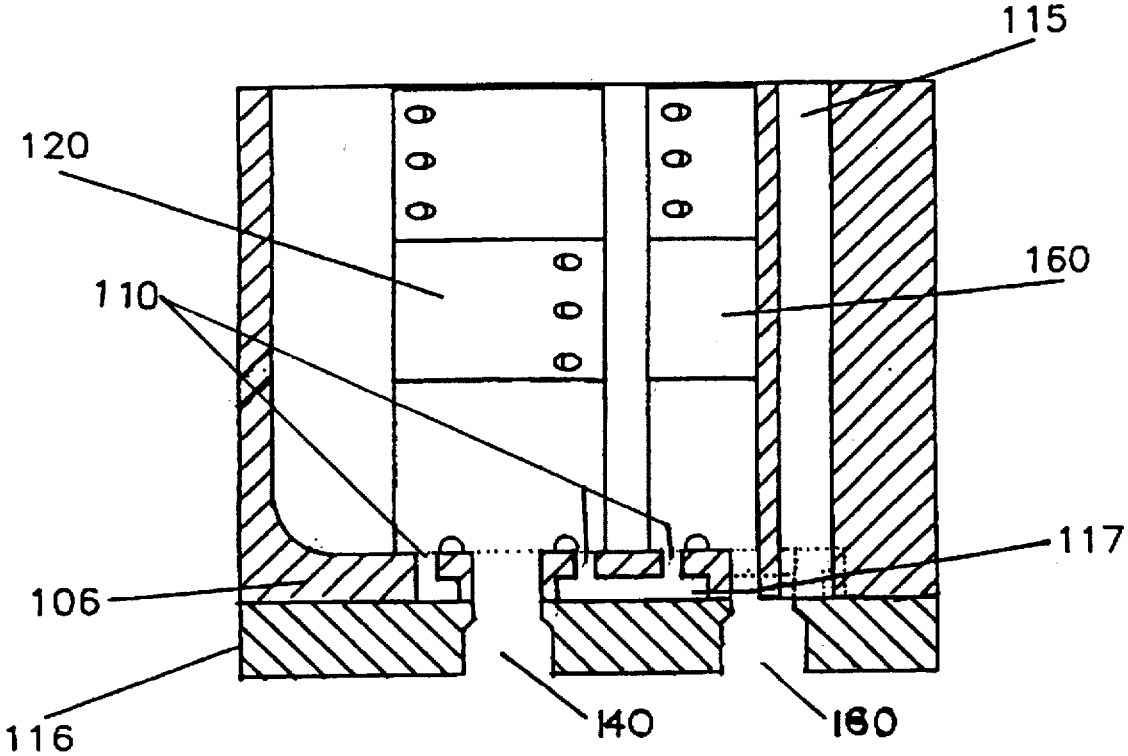
FIG. 4 is a cross-section of the hollow-body portion along line 4—4 of FIG. 2.
Figure 5:
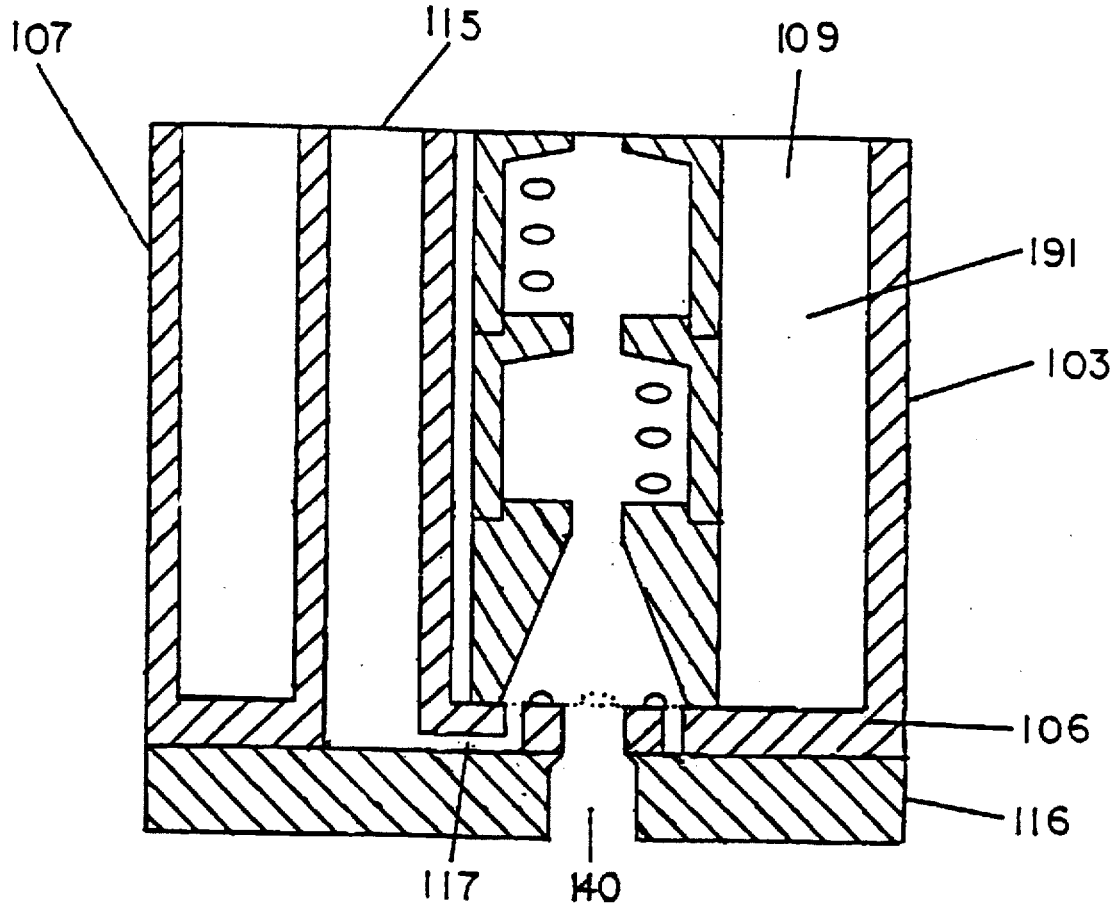
FIG. 5 is a cross-section of the hollow-body portion along line 5—5 of FIG. 2.

As best illustrated in FIGS. 2, 4 and 5, one of the vertical walls 103 has a section 114 protruding into the fuel chamber 109 that includes a conduit 115. As explained hereinafter, the conduit 115 forms part of a channel for returning unvaporized fuel to the vortex stacks.

The bottom wall 106 (FIG. 4) having a trough 117 therein is enclosed by the injector plate 116 having through orifices 140 and 180, which and communicate with the outside of the vortex air chamber 109 (FIG. 5) the bore conduit 115, trough 117 and openings 110 (FIG. 2) a second delivery inlets for returning unvaporized fuel to the base vortex stack openings 110 through trough 114 surrounding EFI injectors (179 FIG. 1) in through holes 140 and 180 (FIG. 2).

Next, the main air section 200, as illustrated in FIGS. 1, 6–13 is described. The main air section 200 (FIG. 9) comprises a main air housing or throttle body venturi housing 202 having an enlarged interior air intake opening 203 forming a main air input 201 (FIG. 10), a throat 204, a throttle body venturi chamber 228, and an enlarged discharge opening 205. A venturi insert, identified as a throttle body venturi vacuum enhancing vortex stabilizer 218 FIGS. 1, 3A, 11 and 17 which also functions to evenly distribute the stack output fluid within the main air housing 200 (FIG. 1).

A conventional butterfly throttle plate 206 (FIG. 9) is mounted within the hollow interior of the throat portion 204 of the housing just inside the air intake opening 203. The throttle plate 206 is conventionally and non-rotatably secured to a rotatable central shaft 207, which is disposed in an attitude transverse to the direction of air flow through the interior of the housing. Rotation of the shaft 207 will adjust the inclination angle of the throttle plate within the interior of the housing, thereby changing the volume of air air/fuel mixture admitted into the engine.

Disposed within the bottom wall 208 (FIG. 10) of the throttle body venturi housing 202 is a circular recess 209 and a longitudinal hollowed out portion 210 within the circular recess 209. Also, the bottom wall 208 has a through hole 211 (FIG. 11) in communication with a passage formed by the throttle body venturi annular ring 235 and the outlet orifice(s) 236 (FIG. 11). Within the enlarged interior opening is placed the throttle body venturi-vacuum enhancing vortex stabilizer 218 (FIG. 11).

Also, disposed within the bottom wall 208 (FIG. 10) of the venturi housing, adjacent to the enlarged interior intake opening 203, is a hollow interior channel 212 forming an air passageway between an inlet 221 in the interior of the throttle body venturi housing 202 and an outlet 222 in the outside of the bottom wall 208 (FIG. 10) in communication with the air chamber 109 (FIG. 5) as will be described hereinafter.

Figure 14:
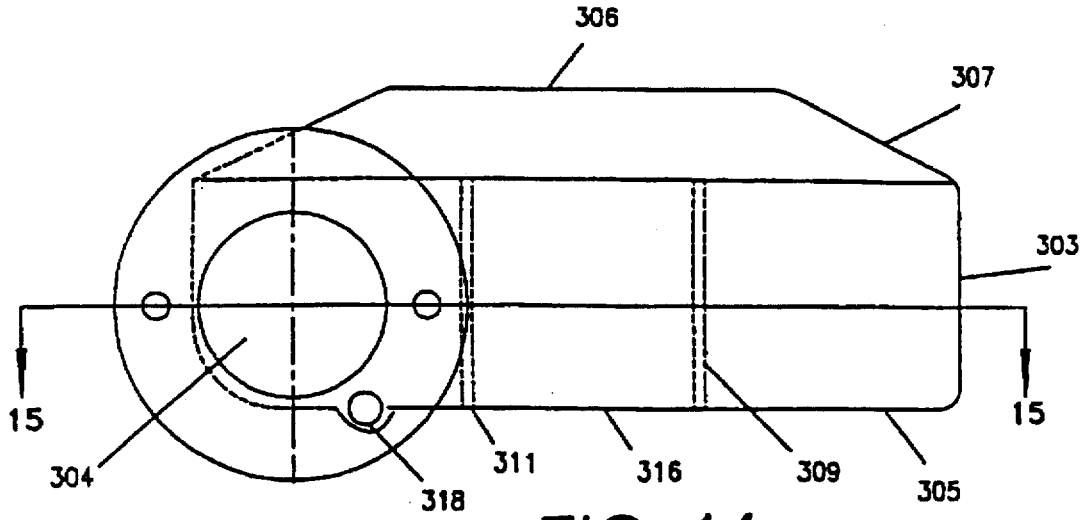
FIG. 14 is a view of the fuel-air input end of the cyclone of the cyclone vortex system.

Further, the bottom wall 208 (FIG. 11) has another hollow interior channel 213 that forms a passageway between an inlet 223 in the discharge opening end 205 of the venturi housing 202 and an outlet 224 in the outside of the bottom wall 208 and communicates with 318 (FIG. 14).

Figure 8:
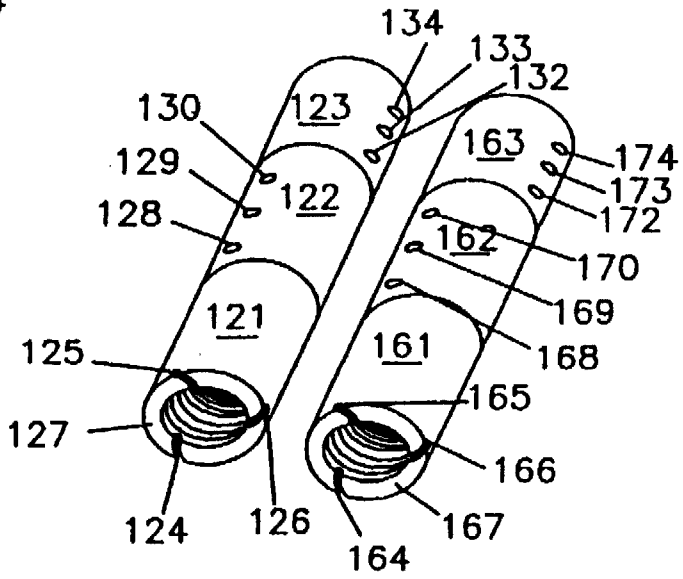
FIG. 8 is a perspective view of the multiple element vortex stack configuration of the cyclone vortex system.
Figure 10:
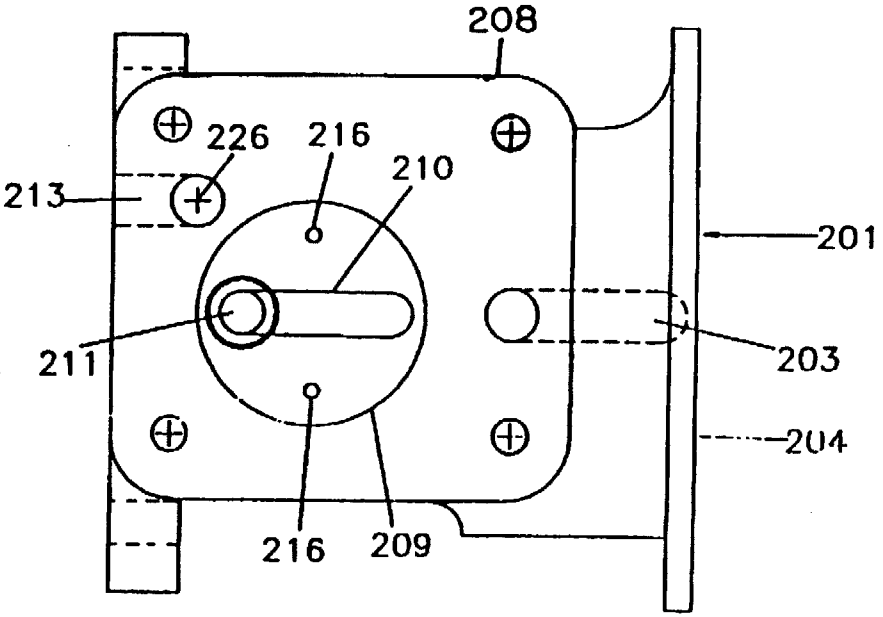
FIG. 10 is a bottom view of the throttle body venturi of the cyclone vortex system, showing the openings for idle air, vaporized fuel-air and/or fuel aerosol, recycle fuel, and the location of the vortex stack plate.
Figure 9:
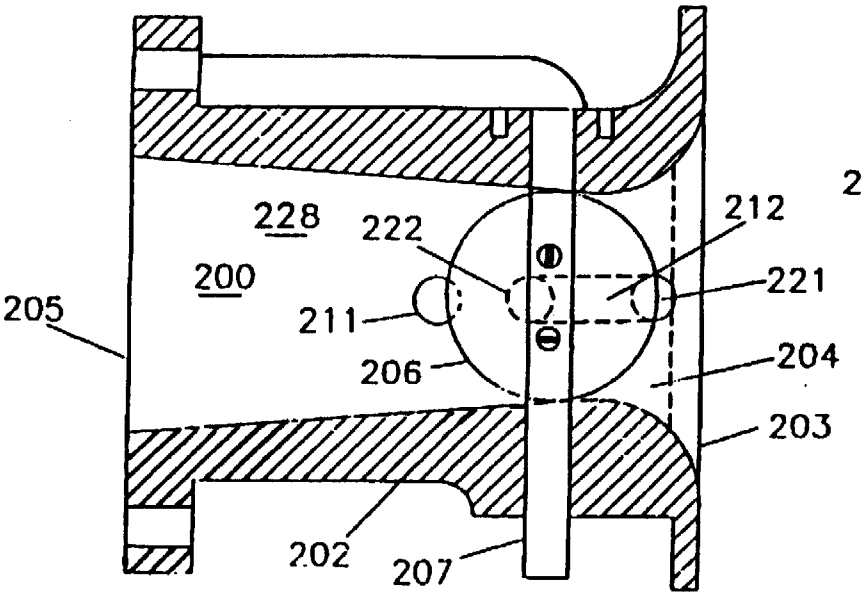
FIG. 9 is a horizontal cross-section of the throttle body venturi of the cyclone vortex system along line 9—9 of FIG. 12.
Figure 11:
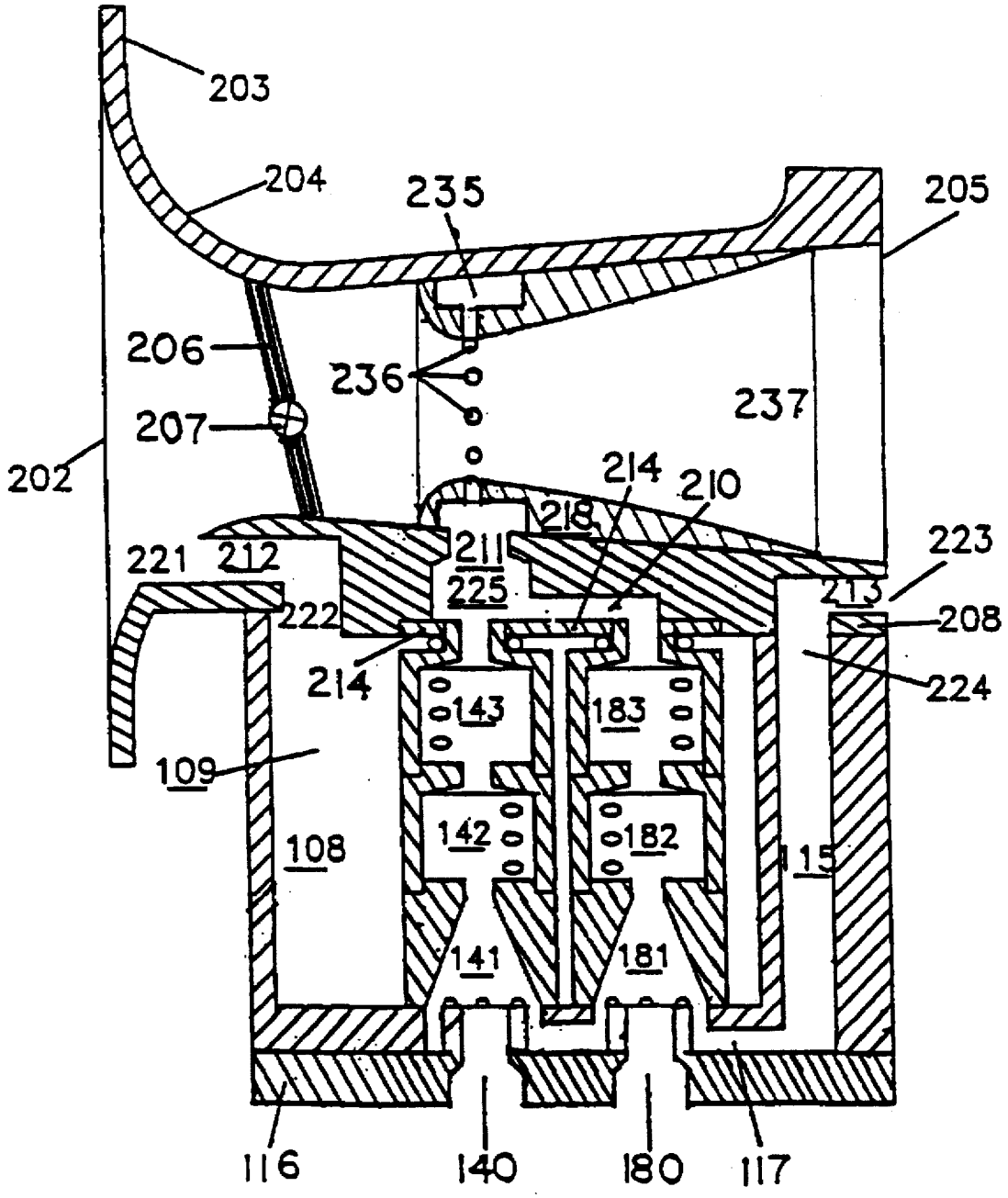
FIG. 11 is a vertical cross-section of the throttle body venturi and fuel vaporizing section of the cyclone vortex system, showing the atmospheric air inlet channel, the vortex stack connecting channel and the fuel recycle return channels along line 10—10 (and 10*a*—10*a*) of FIG. 12.
Figure 13:
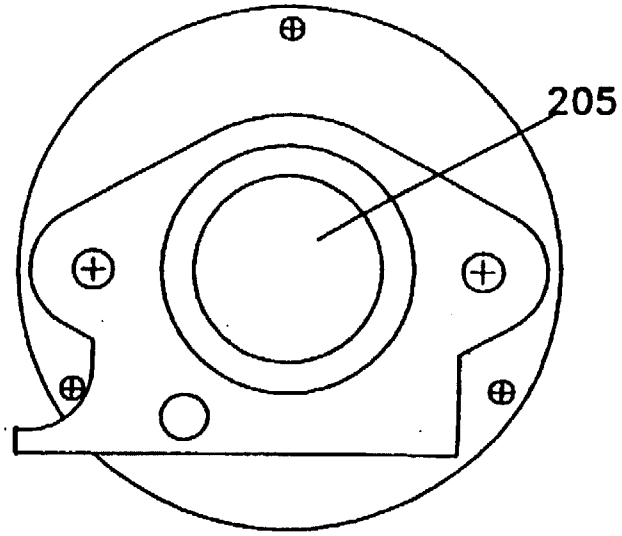
FIG. 13 is a view of the fuel-air output end of the throttle body venturi of the cyclone vortex system showing the recycle inlet opening.
Figure 12:
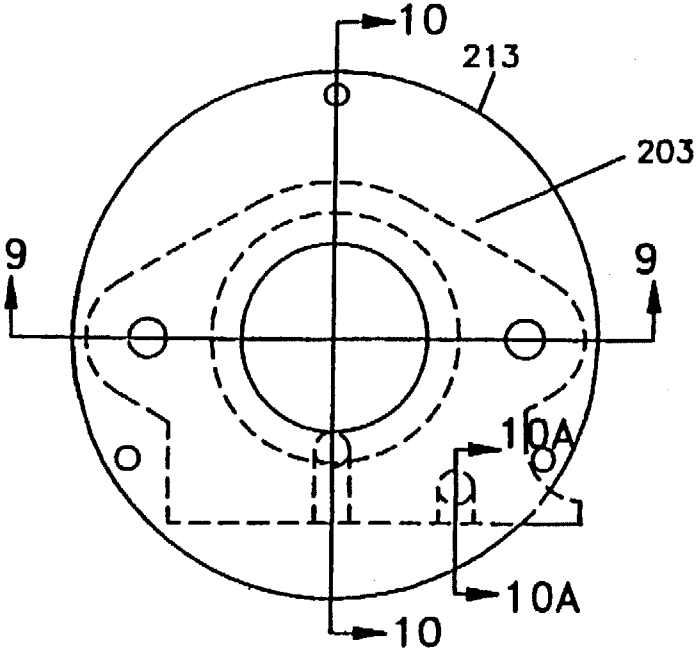
FIG. 12 is a view of the air input end of the throttle body venturi of the cyclone vortex system.

A plate 214 (FIG. 11) is positioned within the recess 209 (FIG. 10). The plate is approximately the same size and shape as the horizontal cross-section of the recess 209. The plate 214 (FIG. 1) has a pair of through holes 215 that mate with a pair of threaded holes 216 (FIG. 10) in the recess 209. The plate 214 (FIG. 7) is attached to the venturi housing 202 (FIG. 9) within the recess 209 (FIG. 10) by conventional fastening devices by means of the through holes 215 (FIG. 1) and the threaded holes 216 (FIG. 10). Also, the plate 214 (FIG. 1) has a pair of larger holes 217 having approximately the same size and shape as the respective necked-down portions 137 (FIG. 6) of the top accelerator vortex units 123 and 163 (FIG. 8). The plate 214 (FIG. 11) forms the bottom of a vortex chamber 225 and the channel 210 in the bottom wall 208 of the venturi housing 202.

Figure 15:
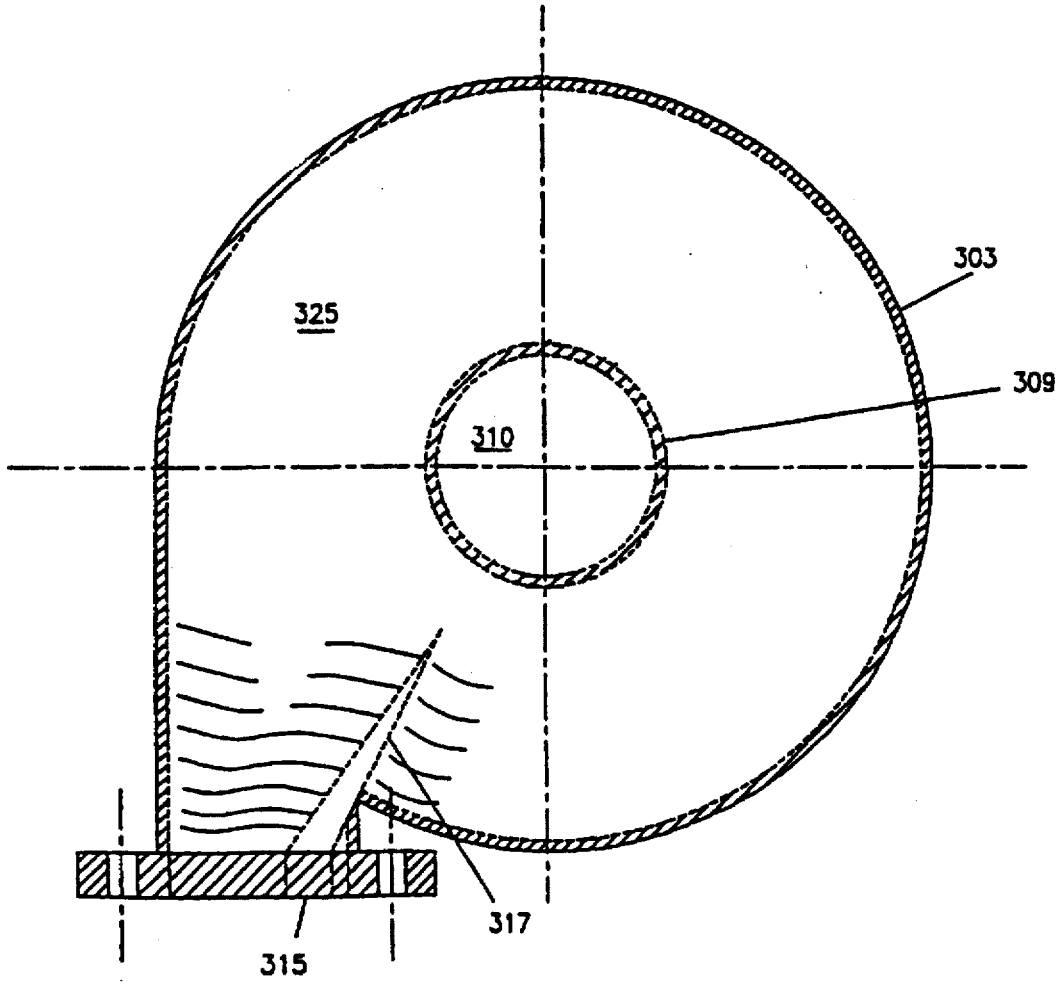
FIG. 15 is a horizontal cross-section of the cyclone of the cyclone vortex system along line 15—15 of FIG. 14.

Next, the fuel scrubbing-mixing section, illustrated in FIGS. 1, 14 and 15, is described. The fuel scrubbing-and mixing section 300 (FIG. 1) includes a centrifuge or main cyclone housing 302 that is a generally cylindrical configuration comprising, an annular vertically directed wall 303 (FIG. 14) interrupted by a main intake opening 304 and a return opening 318. The wall 303 is integral with a bottom wall 305.

The housing 302 also comprises a horizontal top plate 306 and that has a sloping portion 307, which sloping portion is integrally united along its peripheral edge with the top edge of the annular wall 303, thereby closing in air tight relation the entire top of the housing to form a centrifuge or centrifugal-mixing scrubber chamber, or cyclone chamber 325 (FIG. 15).

A central barrel 309 (FIG. 14) having a circular hollow interior 310 (FIG. 15) is disposed within the housing 303 (FIG. 1). The lower portion of the central barrel 309 (FIG. 17) is integrally united along its peripheral edge 311 (FIG. 14) with the bottom wall 305 forming the gas-phase output opening 316 in the bottom wall. The upper end of the central barrel 309 is spaced a predetermined distance below the top plate 306 to accommodate the flow of the vaporized gas-phase fuel-air mixture over the edge of 309 and through the hollow interior 310 (FIG. 15).

Disposed along the bottom of the bottom wall 305 (FIG. 14) is channel 317 (FIG. 15) in communication with the return opening 315 in the annular wall 303.

In assembling the cyclone vortex system, the throttle body venturi housing 202 (FIG. 1), including the plate 214 is fitted or slipped over the vortex stacks 120 and 160 with the necked-down portions 137 (FIG. 6) of the top accelerator vortex units 123 and 163 (FIG. 8) inserted through the larger holes 217 (FIG. 1) in the plate 214, and is positioned over the hollow body 102.

The bottom plate 116 is positioned below the bottom wall 106 of the hollow body 102 and the trough 117 which communicates with conduit 115 and opening 110 (FIG. 5).

The bottom plate 116 (FIG. 1) is provided with bolts 404 and gaskets 407 and 408 for securing and sealing the venturi housing 202 and the bottom plate 116 to the hollow body 102. In addition, fastening means 405 and 406 and a gasket 408 are provided for attaching the centrifuge 302 to the venturi housing 202. Also, O-rings 409 are provided that fit around the necked-down portions of the top accelerator units 123 and 163 (FIG. 8). Further, another sealing ring 410 (FIG. 1) is provided for sealing the vortex top plate 214 (FIG. 7) and the bottom wall 209 (FIG. 10).

Figure 16:
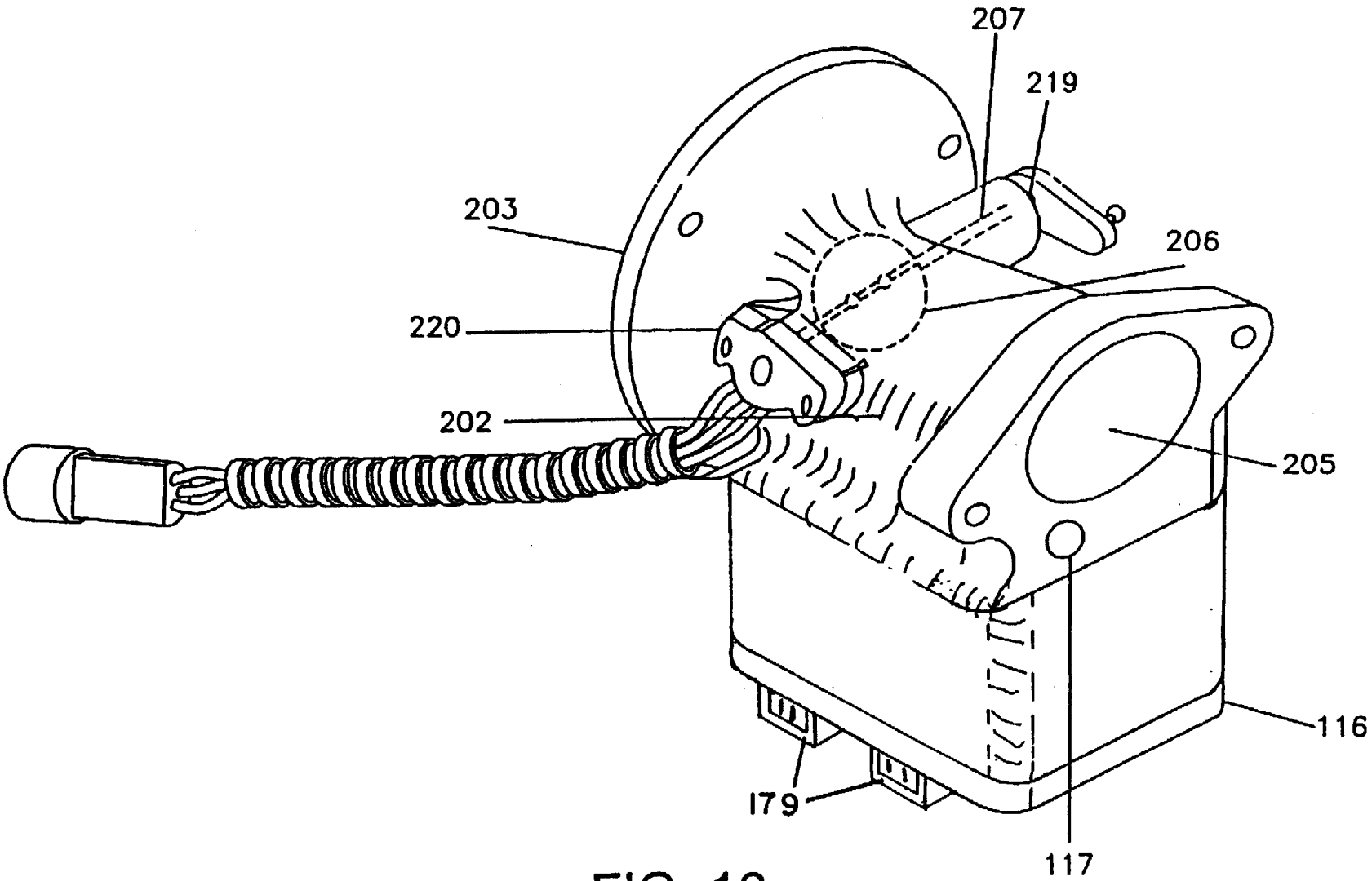
FIG. 16 is a perspective view of the cyclone vortex system showing the relationship between the inputs for the fuel injectors, the throttle position sensor and the throttle ball crank.

The electronic and control components are shown in FIG. 16, the venturi housing 202 is provided with a throttle ball crank assembly 219 and a throttle position sensor assembly 220 which controls the EFI fuel metering system components 179 (FIG. 1).

Operation

The operation of the cyclone vortex system follows. Liquid, (fuel) is electronically controlled and metered becoming an aerosol, through the inputs 140 and 180 (FIG. 11) into chambers 141 and 181 in response to the throttle position sensor 220 (FIG. 16). The throttle sensor is coupled to the central shaft 207 of the throttle plate 206. The throttle plate is controlled by a conventional accelerator pedal (not shown). The amount of fuel metered through the fuel input(s) 140 and 180 (FIG. 2) is proportional to the position of the throttle plate 206 (FIG. 11). The liquid aerosol fuel is injected into the air-driven vortex system as a result of EFI controls. Engine created vacuum moves air into the base vortex apertures 124–126 and 164–166 (FIG. 7) in the floor of the hollow body 103 (FIG. 1) and into the base vortex apertures or slots of the vortex stack(s) 120 and/or 160 (FIG. 4).

Figure 17:
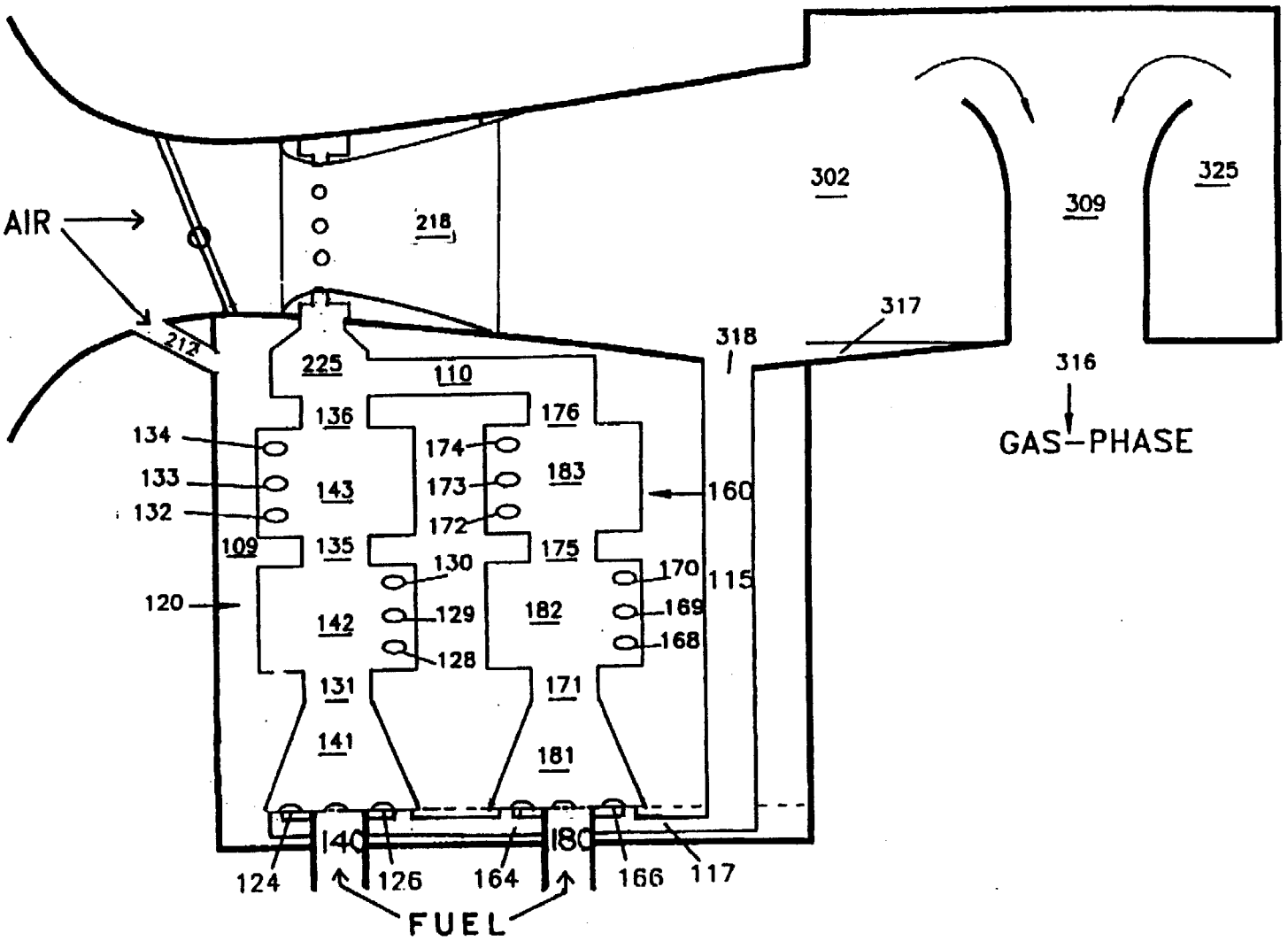
FIG. 17 is a schematic illustration of the cyclone vortex process.

When the engine operates, a partial vacuum is produced in the engine intake manifold. Air enters the enlarged intake opening 203 (FIG. 9) and the vortex air inlet 212 (FIG. 11). The throat configuration 204 of the venturi housing 208 (FIG. 11) causes the velocity of the air rushing through the bore of the venturi housing 202 to accelerate. With the throttle plate closed, the lower pressure air fuel mixture at opening 211 (FIG. 9) is drawn through the vortex stacks 120 and 160 (FIG. 1). The fuel, which enters the base vortex element(s) 121–161 or flow pressure increasing ducts through the injector apertures 140 and 180 or first delivery inlets (FIG. 11), is combined with air entering through the rim apertures 124–126 in the rim 127 and 164–166 in rim 167 (FIG. 8) of the base vortex elements. The air is provided to the vortex stacks via the channel 212, and through air chamber 109 (FIG. 17). The fuel-air aerosol mixture enters the restrictive apertures 131 and 171 (FIG. 17), is rotationally accelerated due to incoming air from apertures 128–130 and 168–170. As the mixture rotates within the chambers 142 and 182 of the intermediate vortices, exits the intermediate vortices through the constricted bores 135 and 175 between the intermediate vortices and the top accelerator vortices 143 and 183, rotates within the chambers 143 and 183 (FIG. 17) of the top vortices as additional acceleration air inputs through orifices 132–134 and 172–174, exits through the constricted bores 136 and 176 (FIG. 17) and enters vortex chamber 225 to combine fluid flows from vortex stacks 120 and 160 and passes then through the hole 211 (FIG. 17) in the bottom wall 208 (FIG. 11) of the throttle body venturi housing 202 into the throttle body venturi annular ring 235 passage of the throttle body venturi vacuum enhancing vortex stabilizer 218 (FIG. 17). Any of the recycle fuel entering chambers 181 or 141 of the base vortex elements 123 and 161 (FIG. 8) through the opening(s) 110 (FIG. 2) and injected fuel through opening(s) 140 and 180 is all converted into a fuel aerosol within the base vortex elements. The lighter components of the fuel vaporize readily. While passing through the chambers 142, 143, 182 and 183 of the intermediate accelerator chambers the fuel-air mixture is acted upon by air flowing through the apertures 128–130 and 168–170 into the intermediate accelerator chambers and the apertures 132–134 and 172–174 in the top acceleration chambers, the apertures being arranged tangentially to the main vortical flow path so that incoming air accelerates the spinning motion of the fluid column. This vorticular or spinning flow greatly increases the mean free flow path which the fuel-air mixture must travel and thereby results in more complete vaporization of the fuel by enhancing the turbulence between the fuel and the air. The fuel-air fluid stream progresses through the venturi annular ring 235 (FIG. 3A) and orifices 236 (FIGS. 3A and 3B) into the venturi's chamber 237 (FIG. 17) of venturi 218 (FIG. 17) and into the large chamber of the fuel scrubbing cyclone section 300 (FIG. 1) through opening 302 (FIG. 17) where the fuel-air flow is acted upon by centrifugal force in the centrifuge chamber 325 (FIG. 17). There, any remaining aerosols recondense as liquid and are collected in channel 317 (FIG. 15) and returned through the recycle channels comprising, the return opening 315, the hollow internal channel 213 (FIG. 11), the conduit 115, the trough 117 and the openings 110 or second delivery inlets to the vortex stack(s) 120 and 160 (FIG. 1) where the fresh and recycle fuel components are combined within the fluid vorticular flow exiting the base vortex(s). The recycle fuel enters the base vortex elements 161 and 121 (FIG. 8) through the opening(s) 110 (FIG. 2) in the bottom wall 106 (FIG. 5). The fresh fuel enters the same base vortex elements 161 and 121 (FIG. 8) through the fuel injectors (EFI) 179 (FIG. 1) in apertures 180 and 140 (FIG. 11) in the bottom wall 106 (FIG. 5) and base plate 116. The two accelerator vortex elements 162 and 122 operate in a manner similar to the top acceleration stacks elements 163 and 123. The fluid product from stacks 120 and 160 (FIG. 17) passes into the venturi chamber 218 (FIG. 11) through the hollowed out portion 210 (FIG. 10) and the vortex chamber 225 (FIG. 11) through hole 211 in the bottom wall of the venturi housing 208. The vortex stack(s) operate to vaporize all the liquid and/or aerosol into a gas-phase.

Next, the detailed operation of the cyclone vortex system will be described with reference to FIG. 17, which is a schematic depiction of the system. Like numerals are used in FIG. 17 to designate the portions of the schematic representing like parts shown in the other figures.

The vortex stack(s) 120 and 160 (FIG. 17) are physically identical and operate in the same manner. Both liquid recycle and EFI inputs are balanced to all stacks (when multiple stacks are used). Fresh fuel aerosol-liquid provided by, for example, electronically controlled fuel injector(s) EFI 179 (FIG. 1) is fed into the base vortex chambers 141 and 181 (FIG 17) or flow pressure increasing duct chambers. Atmospheric air is provided by the hollow internal channel 212 (FIG. 11). The fresh fuel-air mixture is drawn through the vortex stack(s) as a result of engine vacuum (negative pressure) in the venturi chamber 218 at the through hole 211 and sequential passage 235, 236 and 237. Air is drawn through the base apertures 124–126 and 164–166 (FIG. 8). A vortical fluid-air column mixed with EFI injected fuel from injectors in openings 140 and 180 (FIG. 11) or first delivery inlets is established in each of the base vortex chambers 141 and 181. The angularity of the apertures 124–126 and 164–166 (FIG. 8) causes air fuel aerosol-fluid to spin or rotate within the chambers 141 and 181 (FIG. 7). The rotational movement of the fuel aerosol and air within the vortex chamber(s) 141 and 181 creates a centrifugal or outward force on the fuel aerosol droplets within the fluid column. The fluid mixture column accelerates as the pressure differential changes between the input and output of the constricted bores 131 and 171. The vortical column of fuel aerosol is further accelerated upon passing through the constricted bores 131 and 171 into chambers 142 and 182 and is further acted upon by the pressure differentials and the air inflows from accelerator vortex apertures. The accelerator vortex apertures are axially tangential to the now established coherent fluid-air column. Vacuum (pressure differential) driven air flowing into the accelerator chambers 142, 143, 182 and 183 (FIG. 7) by way of the apertures 128–130, 132–134, 168–170 and 172–174 (FIG. 8) enters the fuel-rich-air-fluid column and enhances the vortex turbulence-envelope while increasing the rotational and columnar velocity.

The fluid column is thus acted upon by high velocity vortical air inflow into the vortex envelopes from the apertures 128–130 and 168–170. As the column moves from chambers 142 and 182 (FIG. 7) and subsequently, into the chambers 143 and 183, further vortical air inflows from apertures 132–134 (FIG. 8) and 172–174 act on the vortex envelopes.

Shear forces are developed within each vortex envelope and enhanced by the pressure differentials within chambers 142, 143, 182 and 183 (FIG. 7) at the vortical turbulence interface and at the bores 131, 135, 171 and 175. The rotational vortical speed is accelerated by the vacuum induced inflow into each turbulence envelope by the vectored air inflow from apertures 128–130, 132–134, 168–170 and 172–174 (FIG. 8).

All aerosol particles in the vortical column are acted upon by the centrifugal force as a function of their mass, and the pressure differentials affecting them, the heavier fuel aerosol particles will be diminished in size as they are sheared at the vortical turbulence interface. Some particles may pass through the turbulence envelope to impinge on the vortex chamber inner surfaces (walls). Fuel ligaments will form and either develop plume segment droplets or progress as a liquid film by gravity to the bores 131, 135, 171 and 175 (FIG. 7) where the fluid column will re-acquire the liquid for further processing within each pressure differential envelope at the turbulence interface. Within the vortically spinning aerosol containing column, the largest or heaviest particles are moved to and/or through the column surface first and acted upon by the shear forces and pressure differentials in the chambers 142, 143, 182 and 183 until the remaining "heavy ends" of the hydrocarbon molecule particles are carried by velocity flow through the vortex chamber 225 (FIG. 17) and the venturi 218 into the centrifuge chamber 325 where a significant pressure-velocity reduction occurs, allowing any remaining "heavy fraction" (heavy ends) aerosols to recondense as liquid and be conveyed through the recycle channels 115 and 117 (FIG. 17) and into the second delivery inlets 110 of the vortex base stack elements 121 and 161 or flow pressure increasing ducts.

As the fluid column enters each sequential constriction, velocity increases and upon exit into the next chamber there is a pressure differential and velocity change in the fluid column particles within and on the surface of the columnar flow as the larger cavity is entered. After each pressure differential occurs, vortical air inflows occur and the rotational columnar speed again increases. Aerosol loading within the fluid column will attempt to stabilize at any increased pressure velocity, which brings the more massive of the remaining aerosol particles to the column surface and into the turbulence-pressure-zone envelope. Thus, it can be assumed that within the cyclone vortex system, the vortically-vectored air-fluid rotation turbulates-shears the liquid first to aerosol, then to a gaseous fluid and finally to the near sonic velocity gas-phase-fluid state as the fluid column enters the passage of the throttle body venturi annular ring 235 (FIG. 11), spreads and homogenizes around the passage of the ring 235, and exits the transfer orifices at 236 and 237.

As used herein, the term "heavy end or fraction" used to describe the recycle fluid, includes not only the high molecular weight long-chain aliphatic hydrocarbons, but also the aromatic compounds of benzene, xylene, toluene etc. or any other blending components, which have not been vaporized into the gas-phase during the first transit through the vortex stacks as fresh fuel. It should be apparent from the discussion that any "heavy ends" from the liquid-fuel aerosol will recycle until they are vaporized and become a gas phase fuel.

The vortex stacks 120 and 160 (FIG. 1) function exactly the same in receiving fresh fuel and/or recycle liquid which is returned by gravity and vacuum through designated channels or passageways into the recycle passages and stack base vortex recycle feed apertures 110 and thence into stacks 120 and 160 where it is combined with the fresh injected fuel through apertures 140 and 180 to establish the spinning columnar and vortical fluid flow and shear interactions, previously described, and which occur in the base chamber 141 and 181 and successive vortex chambers 142 and 182 and 143 and 183. Both vortex stacks are configured and fuel processing events sequenced to convert all of the liquid or aerosol received into the gas-phase state.

All of the gas-phase fluid containing any unprocessed fuel aerosol from stacks 120 and 160 (FIG. 1) enters the vortex chamber 225 (FIG. 17) where fluid flows are combined before entering the spreader passage of the throttle body venturi annular ring 235 of the throttle body vacuum enhancing vortex stabilizer 218. The throttle body venturi chamber 228 functions to maximize the vorticular flow as determined by the engine vacuum on the vortex stacks, and starts the final mixing of the fuel-rich vortex product as it enters the homogenizing spreader passage of the throttle body venturi annular ring 235, is combined with the throttled air flow in the throttle body venturi chamber 228 and goes into the centrifuge aerosol scrubbing chamber 305, and progresses thence as a gas phase fuel into the engine manifold (not shown) after passing through the central barrel 309.

By way of example, the following details of construction are provided in order to better define the structure, operation and application of the cyclone vortex system.

Key features of the cyclone vortex system are the sequential high velocity low-pressure, reduced velocity vortex turbulence chamber(s) and the chamber 225 (FIG. 17), which is approximately five times the cross-sectional area of all the vortex apertures in the two vortex stacks 120 and 160 (FIG. 1). At chamber or vortex 225 (FIG. 17), the fluid flows from the vortex stacks are first combined, then further homogenized with the throttle plate controlled air flow through the venturi apertures 236 (FIG. 11) in the throttle body vacuum enhancing vortex stabilizer 218. The main intake opening 304 (FIG. 14) of the centrifuge 304 is 163 times the total cross-sectional area of all the apertures in the vortex stacks 120 and 160 (FIG. 1).

In the preferred embodiment, the acceleration vortex chamber apertures 128–130, 132–134, 168–170 and 172–174 (FIG. 8) are positioned tangentially into the vortex inside periphery at a 90° axial angle to provide maximum vorticular effect and columnar rotation. Also, the centrifuge housing 302 (FIG. 17) is slanted so that gravity can assist the recycle fuel to flow into the channel 317, the recycle channels 318, 115 and 117 to balance the collected recycle flow equally into the vortex base elements 141 and 181. The bottom wall trough 317 is shaped to collect the recycle fluid.

The distance between the top of the centrifuge 306 (FIG. 14) and the top of the barrel 309 is 0.900 inches, but may be different for each engine size category and/or fuel quality.

In the application of the preferred embodiment, engine idle speed is determined by the total vortex flow capacity and must be predetermined for each general engine size application. The idle speed adjustment screw on the throttle plate bell crank means of past practice is conventionally applied. Higher engine operational speeds are determined by throttle plate position and/or other fuel input parameters.

Based on the mathematical calculations of engine cylinder (s) swept volume, revolutions per minute, and the total cross-section area of apertures (FIG. 17) 124–126, 128–130, 132–134, 164–166, 168–170 and 174–176 of the vortex stacks 120 and 160, the velocities of some of the air-fluid flows entering the column and exiting the vortex chamber into the venturi through the through hole 211 is at "near sonic velocity" for a 5.7 liter engine at 1,000 R.P.M. For many "well tuned" engines, this is approximately "idle" speed.

As is common practice with all automobile gasoline engine applications, an inlet air pre-heater, temperature sensor and control means may be used to maintain constant inlet air temperature for either the venturi and/or the vortex. Fuel may be supplied by means of an original equipment high pressure fuel pump and fuel injectors (EFI) and may also be supplied to the CVS system by a low pressure fuel pump to a conventional float bowl with jet and/or metering rod control systems as per conventional carburetion devices.

Testing has indicated that the present invention is far superior to the device disclosed in the two prior patents U.S. Pat. Nos. (4,515,734 and 4,568,500).

The original unleaded gasoline, the recycle liquid coming from the centrifuge chamber and the fuel stock entering the cyclone venturi system were analyzed by infra-red spectroscopy to detect possible oxygenated species being formed by the cyclone vortex process, and by gas chromatography to characterize the aliphatic and aromatic components of these fractions. The gasoline and recycle liquid were analyzed directly from the liquids while the fuel stock entering the system was captured by bleeding the gaseous material from the intake manifold into a vacuum flask prior to analysis.

The infra-red spectra showed the absence of the most likely oxygenated species, alcohols and aldehydes, since there was no detectable absorption due to —OH alcohol bonds or the carbonyl bond of aldehydes, ketones or acids. Therefore the favorable combustion properties of the fuel processed through the cyclone vortex system was not due to chemical oxidation reactions of the fuel components within the cyclone vortex system.

Figure 18A:
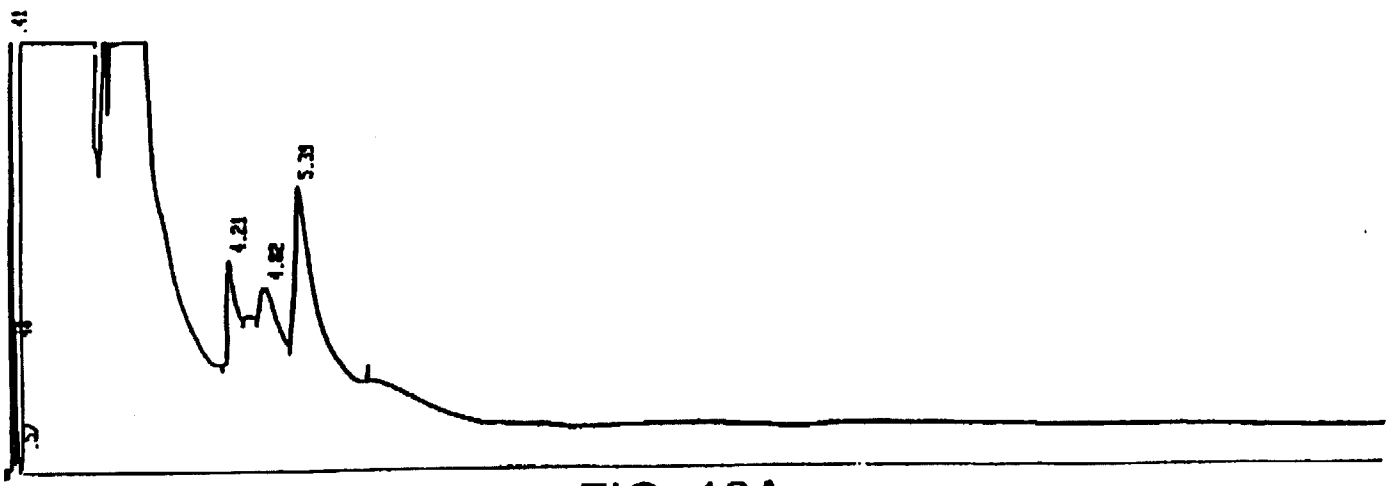
FIG. 18(*a*) is a chart showing the concentration of the molecular components of gasoline.
Figure 18B:
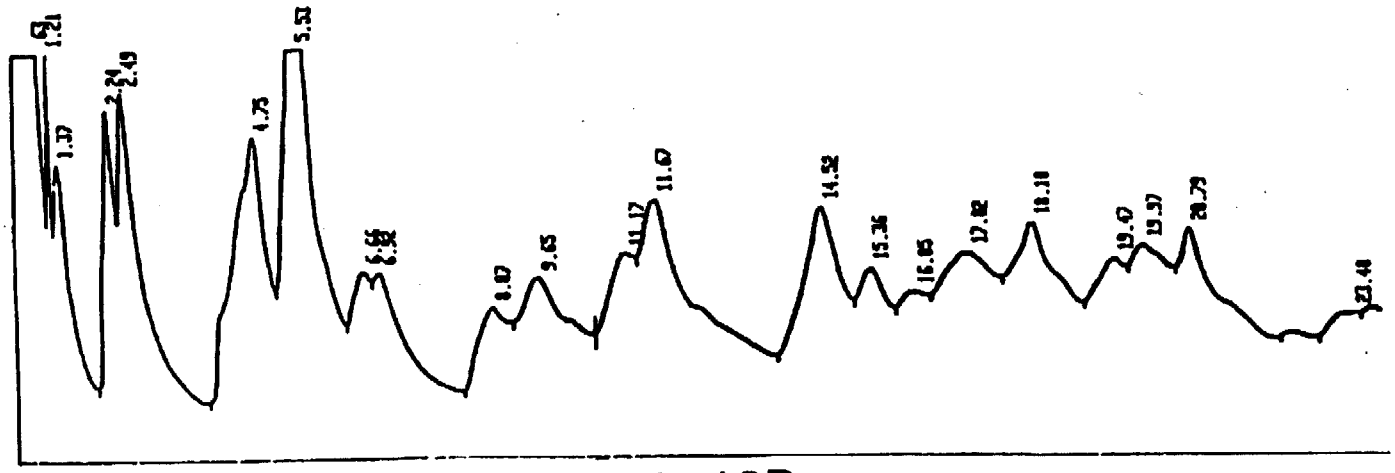

Gas chromatography showed major differences between the original gasoline fraction and the recycle liquid coming from the centrifuge chamber of the cyclone vortex system. The data are shown in FIG. 18(*a*). For this analysis the gasoline and recycle fluid were diluted with pentane to obtain a concentration of the fuel components appropriate for analysis with the gas chromatograph. FIG. 18(*a*) and FIG. 18(*b*) are a composite of two analyses, and the data are included together for ready comparison. The retention times on the abscissa are in minutes, and the ordinate is the absorption of the individual components, which is proportional to concentration. The data were obtained with a Hewlett Packard 5890 Gas Chromatograph apparatus with an automatic sample injector, using a HP-1 (ultra 1) methyl silicone phase capillary column (15 m×0.2. mm). The operating conditions were: 30° C., hold 5 min., increase 5° /min. to 235° C., hold for 1 min. The sample size was 1 ul.

FIG. 18(*a*) is a spectrum obtained by gas chromatography of the gasoline fuel entering the cyclone vortex system. The components coming off with low retention times (up to 2.51 minutes) are the low molecular weight aliphatic hydrocarbons (pentane, hexane, heptane, octane), which are the major components of gasoline fuels.

FIG. 18(*b*) shows similar data for the recycle liquid coming from the cyclone chamber using the same conditions of analysis. The low molecular weight (light) aliphatics are now seen as mirror components of the total recycle liquid, while the heavier, less easily vaporized components (aromatics and higher molecular weight hydrocarbons), are concentrated in this fraction and are readily apparent. These heavier components (longer retention times) are also present in the original gasoline fuel, but are not apparent in FIG. 18(*a*) since their concentrations are so low they were not detected at the instrument sensitivity used for these analyses.

Collection of the non-vaporized heavy aerosol components shown in FIG. 18(*b*) by means of the cyclone scrubber section of the cyclone vortex system is a major achievement of the invention since it prevents their entry into the intake manifold or engine combustion chamber as unvaporized droplets which universally occurs with all current aerosol fuels. Subsequent retreatment of the recycle liquid through the recycle vortex stack (one or more times) leads to the vaporization of these heavy components, allowing them to join the other vaporized components of the fresh fuel and pass into the intake manifold in their readily combustible gas-phase state.

Three Ford original equipment manufacturer (OEM) engines have been selected as being typical from many which have been are operating using the cyclone vortex system in place of a stock carburetor or electronic fuel injection (EFI) system. One of the engines was a four cylinder engine having a displacement of 2300 cubic centimeters. The other two engines were eight cylinder engines, one having a displacement of 351 cubic inches, and the other having a five liter displacement. All engines showed remarkable improvements in fuel mileage with the cyclone vortex system. For example, the four cylinder engine, using the cyclone vortex system, exhibited an improvement of over 40% running at engine speeds of 40 and 50 miles per hour. Likewise, the eight cylinder engine operating at 40 miles per hour had an improvement of over 40% and at 50 miles per hour, had an improvement of over 29%. The five liter engine showed a 17% improvement operating at 65+ miles per hour.

In addition, an analysis of the emissions exiting the five liter engine showed that without the cyclone vortex system, the level of carbon monoxide was 0.61% with 136 parts per million of hydrocarbons. With the cyclone vortex system and with all emission control equipment removed, the level of carbon monoxide was 0.02% with only 3 parts per million of hydrocarbons.

Variations of the embodiment described above for use in preparing fuel for internal combustion engines, external combustion devices and other gassifying-liquid reduction systems are possible.

At the outset, it is pointed out that the cyclone vortex system has wide and important applications since it provides the unique vorticular treatment of fluids. The cyclone vortex system is applicable for homogeneously modifying and controlling the state and composition of hydrocarbon fuels as well as other industrial process controlled fluids.

Hence, the vortex configuration can be varied as to number of vortex units, as well as the number, sequence and location of apertures in each acceleration or stack element in the vortex unit to optimize the columnar rotational speed and mean free air flow path to optimize turbulence, pressure differentials, control the fuel or liquid processing rate, and especially the quality of the output gas-phase mixture.

For example, with gaseous fuels (propane, LNG, CNG, etc.) the primary function of the vortex stack(s) and the centrifuge, if or when required, is to homogenize the air-fuel fluid to molecularly stoichiometric proportions, which may require a different processing stack sequence than an oxygenated gasoline-alcohol blended fuel or mono- fuel or liquid.

For low horsepower single or multiple cylinder or micro sized engines, the entire air flow can be routed through a multiple venturi-vortex configuration, which utilizes conventional "diaphragm" or metering rod or metering jet means to manage fuel flow in conjunction with a cyclone vortex system fuel feed.

In addition, the number, dimensions, and configurations of apertures or slots in the rim of each base vortex unit can be varied to optimize fuel input and vorticular speed. For example, the annular slot(s) (or flow capacity thereof) in each base vortex unit could be configured as continuously variable and responsive to the throttle position and, changes in the fuel processing requirements, all of which can affect cyclone scrubber capacity requirements and "recycle" fuel flow rate.

In another variation, the vortex units from both stacks can be configured into one stack to allow variations in fuel input and to maximize processing efficiency for both fresh and/or recycle fluid. In this variation, both the recycle liquid and the fresh fuel would be fed directly to the base vortex input of the single stack where the interior shape of the base vortex is smoothly tapered but spirally machined from the rim to the first bore constriction. Enhancement of ligamented film flows on the interior walls of the accelerator vortex chambers may also be accomplished with catalytic coatings or specific roughness machining variations. It is also possible that the constricted bores, such as 131, 135, 171, 175 (FIG. 17) etc. can be treated by micro-machining techniques to enhance or optimize plume droplet formations and liquid re-entry into the vortical fluid column.

Moreover, the vortex configuration can be matched to the engine size depending on whether the engine, for example, is a small engine, a single or multiple cylinder engine, a four cycle engine, or a two cycle engine with lubricating oil injection into the fuel-air fluid stream between the cyclone vortex system and the crankcase or manifold entry port.

The vortex stack(s) and venturi could be placed in varying positions, i.e., horizontal, vertical, etc., to conform with space constraints and physical-environmental conditions and to optimize fuel-fluid flow rates. This configuration is extremely important when designing fuel systems for use with very simple engines and poor quality fuels.

Further, the preferred embodiment may be modified to provide thermally processed air directly to the vortex stacks to optimize the vaporization rate of specific fuels and/or for cold weather/environment-equipment operation. For example: providing air at 260° F. to the vortex stacks may enhance the fuel processing rate with minimized recycle flows, when a lower temperature feedstock could overload the recycle system. It is desirable to hold venturi air temperatures to the 78°+ range for optimal fuel. vaporization efficiency.

Further, fuel for the cyclone vortex system can be metered and supplied through use of diaphram metering means, conventional float bowl(s), carburetion jets, metering rods, accelerator pumps, etc. into the base vortex as at presently suggested or the fuel inputs (however metered) can be presented into the high velocity airflow zone at 193, 194 or 195 (FIG. 5) through the hollow body vortex 121 or 161 (FIG. 7).

The present invention has been disclosed as being useful primarily for processing fuel such as gasoline into a gas-phase mixture for use in internal combustion engines. However, the cyclone vortex system of the present invention is not limited to preparing such a fuel. Rather, the cyclone vortex system can be used to process-vaporize any appropriate type of fluid. In this context "process" may mean to vaporize to gas-phase only the lighter portions of the fluid to enhance the blending of fluids which would otherwise be difficult or impossible such as hydrocarbon, water and/or hydrocarbon-water blended fuels, various chemical or gaseous fluid flows with differing physical characteristics, i.e., surface tension.

"Process" may also mean to vaporize only the more volatile portion of a fluid and/or combine a gaseous-vapor with an aerosol to enhance chemical mixing or combustion of external combustion boiler fuels etc.

The cyclone vortex system can be utilized to vaporize fluids such as:

1. lighter fuel oils to which residue or surface film controlling fuel additives can then be injected or added;
2. a specific fuel "fraction" or "CUT" from petroleum refinery production for specific internal combustion engine, boiler, or burner applications;
3. viscous vapor concentration, such as propane, liquified natural gas, compressed (cryogenic) natural gas, into a homogenous-non-detonating gas phase;
4. multiple mixed gasses and/or combinations of gasses and liquids for industrial process control or prime mover fuel;
5. oxygenated fuel (alcohol) and/or gasoline-alcohol blends thereof;
6. water as a combustion enhancer for combustion temperature control;
7. water-emulsified-hydrocarbon fuels for either internal or external combustion devices for emissions, efficiency or where residue control is necessary;
8. liquids and/or gaseous materials for enhancing feedstock properties and liquid processing speed in molecular separation sequence and/or gaseous membrane separation technology; and
9. hydrocarbon fuels, and/or combinations thereof for many turbine fuel applications such as jet aircraft with either negative or positive air pressure operating systems.

In processing a particular fluid, the number of vortex stacks, the number of vortex units, and the number of apertures in each vortex unit is determined by the magnitude of the demand for cyclone vortex system processed fluid. Sufficient vortex capacity must exist to convert the fluid-aerosol into the gas-phase without overloading the recycle vortex system. Also, there must be a sufficient number of vortex and vortex stack elements to process the quality and quantity of fuel being presented to the system at the fluid-source input. In fact, for stationary power plants or operations where space and cold weather start-up and shut down are not major concerns, and where the quality of the fluid entering the cyclone vortex system need only be consistent with the primary vortex function, the centrifuge and the recycle feature may be eliminated, allowing for a higher capacity fluid preparation flow through only the vortex stack path. Moreover, the throttling system in the venturi housing could be eliminated for specific applications. In addition, the output from the vortex configuration could be fed directly to the centrifuge when processing slurries and unstable material.

The cyclone vortex system can also be used with positive venturi air pressure where stack pressures are sufficiently elevated to achieve the necessary pressure differentials for appropriate mobile or stationary fuel usage applications such as for external combustion gun burners, heating applications, and other chemical applications and jet engine fuel nozzles. Positive pressure from gaseous fuels will serve the same purpose as an air vortex system driver to enhance vaporization of boiler fuels providing pressure differentials are maintained between columnar air flows, vortex acceleration apertures and stack elements. The cyclone vortex system can also be used as a toxic-waste oil combustion unit for the ecological clean up of PCBs or other toxic materials and for blending mixtures of water hydrocarbon or other industrial materials where heat reduction or chemical blending can be accomplished from the gas phase state.

Advantages of Cyclone Vortex System

The major problems associated with internal combustion engines using a mixture of vaporized hydrocarbons and liquid aerosol droplets are inefficiently performing engines, and air pollution caused by inefficiently performing engines operating at pollution-generating high combustion temperatures. Fuels prepared by the cyclone vortex system have the advantage of dramatically improving engine performance while decreasing all known polluting emissions.

The cyclone vortex system allows efficient combustion of all applicable fuels by stoichiometrically pre-conditioning the fuel and air prior to entry into the engine. The fuel is transformed into a stable (chemically fixed), homogenous, stoichiometric, oxygen balanced, gas-phase state. This promotes an improved distribution of the fuel-air mixture to the cylinders, a much improved combustibility of the fuel/air mixture, and results in an efficient use of the inherent chemical energy in the fuel. More of this chemical fuel energy is converted to work than has ever before been possible.

Moreover, the high temperatures required for fuel vaporization within the intake manifold and cylinder combustion chambers of conventional internal combustion engines are not needed for the fuel prepared by the cyclone vortex system. Combustion temperatures remain at levels less than the threshold temperature above which Nitrogen and Oxygen combine during luminous flame combustion to form NOx (at approx. 2800° F.).

Further, the "heavy ends" of the fuel containing wax-gum elements often are the nucleus for the very large aerosol droplets. The cyclone vortex system separates the larger droplets and the recycle feature captures all liquid aerosols and recycles them until the droplets are reduced to a gas-phase air/fuel mixture, which goes into the engine and is oxidized along with the more volatile fractions of the fuel.

As for improving engine performance the use of cyclone-vortex-system prepared fuel eliminates the typical "flame front" combustion in the engine cylinders. This results in unique improvements in all relevant combustion and emission parameters. There is virtually no "knock" or detonation when operating an engine with fuel processed by the cyclone vortex system with either the compression ratios of around 8 to 9.5:1 found in conventional engines or even with any mechanically attainable higher compression ratios of 20:1 or above. Thus it is possible to operate an engine in its original equipment configuration, or to optimize the BMEP (brake mean effective pressure) by altering the compression ratio, valve timing, and ignition occurrence (timing) to achieve maximum fuel economy and minimum emissions. The stock, the 20:1 plus compression ratio, or supercharged engine configurations will produce operating conditions providing greatly reduced (or eliminated) emissions of carbon, UHC (uncombusted hydrocarbons), CO, aldehydes, and NOx (oxides of nitrogen).

Moreover, the luminous flame front combustion which occurs with current internal combustion engines requires that the spark must start many degrees prior to piston top dead center to allow for "slow" combustion without detonation while still enabling reasonable engine power output. Gasoline that is prepared in the cyclone vortex system has the advantage of combusting without any detonation and with other unique beneficial characteristics such as lower temperature, less NOx, less CO and UHC, where maximum cylinder pressure develops much more rapidly allowing spark-fuel ignition to occur much nearer top dead center (TDC). This focuses more of the available expansion pressure from combustion into usable torque and power.

In addition, luminous flame combustion produces large amounts of radiant and other forms of energy which must then be absorbed by the engine structure and dispersed by the cooling system. A percentage of fuel energy is lost through radiated energy in the combustion chamber. However, cyclone vortex system prepared fuel oxidizes without many of these losses through non-luminous—"blue flame," "cold" combustion.

Further, fuels prepared by the cyclone vortex system should have the benefit of extending engine life. The reduction of carbonaceous particulate matter and possibly organic acids resulting from the incomplete or inefficient combustion will provide the advantage of reducing engine wear. Reduced engine wear can therefore be added to improved fuel economy and increased engine efficiency with the attendant pollution reduction as the real advantages of the cyclone vortex system technology.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of the invention.

What is claimed is:

1. A method of preparing a gas-phase fluid, comprising the steps of:

(a) introducing a two-phase fluid into a flow path, said flow path including a flow pressure increasing duct;

(b) spinning the fluid in said flow pressure increasing duct to create a spinning column of fluid containing aerosol particles;

(c) subjecting said spinning column to rapid differentials in pressure and changes in velocity;

(d) continuously delivering air tangentially to said spinning column to accelerate said spinning column and to create vortical turbulence interfaces with said spinning column thereby subjecting said aerosol particles to shear forces and internal particle pressures for converting the aerosol particles into a gas-phase fluid; and (e) withdrawing said gas-phase fluid thus created while retaining any remaining aerosol particles therein, wherein lighter aerosol particles are continuously converted to a gas-phase fluid while heavier aerosol particles are progressively diminished in size as the aerosol particles are subjected to said shear forces and differential particle pressures.

2. The method of preparing a gas-phase fluid according to claim 1, wherein said flow pressure increasing duct includes a first delivery inlet positioned at the upstream end of said flow pressure increasing duct and at least one inlet positioned on the periphery of said duct at the upstream end of said flow pressure increasing duct, wherein step (b) is performed by passing said fluid through said first delivery inlet and by passing air through said at least one inlet positioned on the periphery of said flow pressure increasing duct.

3. The method of preparing a gas-phase fluid according to claim 2, wherein step (e) includes spinning said remaining aerosol particles to cause said aerosol particles to recondense as a liquid upon a separating surface.

4. The method of preparing a gas-phase fluid according to claim 3, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

5. The method of preparing a gas-phase fluid according to claim 2, wherein said flow path further includes a venturi chamber, and said method further comprises:

(f) following step (d), continuously delivering said gas-phase fluid to said venturi chamber and simultaneously mixing said gas-phase fluid with air in said venturi chamber.

6. The method of preparing a gas-phase fluid according to claim 5, wherein said venturi chamber includes a plurality of openings circumferentially positioned about a throat of said venturi chamber, and an air inlet, wherein step (f) is performed by continuously receiving said gas-phase fluid through said plurality of openings and by receiving air through said venturi chamber air inlet.

7. The method of preparing a gas-phase fluid according to claim 6, wherein step (e) includes spinning said remaining aerosol particles to cause said aerosol particles to recondense as a liquid upon a separating surface.

8. The method of preparing a gas-phase fluid according to claim 7, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

9. The method of preparing a gas-phase fluid according to claim 1, wherein said flow pressure increasing duct includes a first delivery inlet positioned at the upstream end of said flow pressure increasing duct and further includes at least one inlet positioned on the periphery of said duct at the upstream end of said flow pressure increasing duct, a constriction portion downstream of said flow pressure increasing duct, and an acceleration portion having at least one inlet positioned on a periphery of said accelerator portion, wherein:

step (b) is performed by passing said fluid through said first delivery inlet and by passing air through said at least one inlet positioned on the periphery of said flow pressure increasing duct, step (c) is performed by passing said aerosol particles through said constriction portion, and step (d) is performed by passing air through said at least one inlet positioned on the periphery of said accelerator portion.

10. The method of preparing a gas-phase fluid according to claim 9, wherein step (e) includes spinning said remaining aerosol particles to cause said aerosol particles to recondense as a liquid upon a separating surface.

11. The method of preparing a gas-phase fluid according to claim 10, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

12. The method of preparing a gas-phase fluid according to claim 9, wherein said flow path further includes a venturi chamber, and said method further comprises:

(f) following step (d), continuously delivering said gas-phase fluid to said venturi chamber and simultaneously mixing said gas-phase fluid with air in said venturi chamber.

13. The method of preparing a gas-phase fluid according to claim 12, wherein said venturi chamber includes a plurality of openings circumferentially positioned about a throat of said venturi chamber, and an air inlet, wherein step (f) is performed by continuously receiving said gas-phase fluid through said plurality of openings and by receiving air through said venturi chamber air inlet.

14. The method of preparing a gas-phase fluid according to claim 13, wherein step (e) includes spinning said remaining aerosol particles to cause said aerosol particles to recondense as a liquid upon a separating surface.

15. The method of preparing a gas-phase fluid according to claim 14, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

16. The method of preparing a gas-phase fluid according to claim 1, wherein said flow path includes a first delivery inlet positioned at the upstream end of said flow pressure increasing duct and at least one inlet positioned on a periphery of said flow pressure increasing duct at the upstream end of said flow pressure increasing duct, a first constriction portion downstream of said flow pressure increasing duct, and a first accelerator portion having at least one inlet positioned on a periphery thereof downstream of said constriction portion, and at least one arrangement of a second constriction portion and a second accelerator portion having at least one inlet positioned on a periphery thereof, said second accelerator downstream of said second constriction portion, said at least one arrangement downstream of said first accelerator portion wherein:

step (b) is performed by passing said fluid through said first delivery inlet and passing air through said at least one inlet positioned on a periphery of said flow pressure increasing duct;

step (c) is performed by passing said aerosol particles through said first constriction portion;

step (d) is performed by passing air through said at least one inlet positioned on the periphery of said accelerator portion, and steps (c) and (d) are repeated in said at least one arrangement, whereby the heavier aerosol particles are subjected to prolonged turbulence and shear forces.

17. The method of preparing a gas-phase fluid according to claim 16, wherein step (e) includes spinning said remaining aerosol particles to cause said aerosol particles to recondense as a liquid upon a separating surface.

18. The method of preparing a gas-phase fluid according to claim 17, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

19. The method of preparing a gas-phase fluid according to claim 16, wherein said flow path further includes a venturi chamber, and said method further comprises:

(f) following step (d), continuously delivering said gas-phase fluid to said venturi chamber and simultaneously mixing said gas-phase fluid with air in said venturi chamber.

20. The method of preparing a gas-phase fluid according to claim 19, wherein said venturi chamber includes a plurality of openings circumferentially positioned about a throat of said venturi chamber, an air inlet, wherein step (f) is performed by continuously receiving said gas-phase fluid through said plurality of openings and by receiving air through said venturi chamber air inlet.

21. The method of preparing a gas-phase fluid according to claim 20, wherein step (e) includes spinning said remaining aerosol particles to cause said aerosol particles to recondense as a liquid upon a separating surface.

22. The method of preparing a gas-phase fluid according to claim 21, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

23. The method of preparing a gas-phase fluid according to claim 1, wherein step (e) includes spinning said remaining aerosol particles to cause said aerosol particles to recondense as a liquid upon a separating surface.

24. The method of preparing a gas-phase fluid according to claim 23, wherein step (a) further includes combining said liquid with the fluid being introduced into said flow path, said liquid being introduced into said flow pressure increasing duct, whereby said liquid is combined with said fluid being introduced into said flow path for further shearing.

25. A method of preparing a gas-phase fluid, comprising the steps of:

(a) introducing a two-phase fluid into a plurality of flow paths, each of said flow paths including a flow pressure increasing duct;

(b) spinning the fluid in said flow pressure increasing duct to create a spinning column of fluid containing aerosol particles;

(c) subjecting said spinning column to rapid differentials in pressure and changes in velocity;

(d) continuously delivering air tangentially to said spinning column to accelerate said spinning column and to create vortical turbulence interfaces with said spinning column thereby subjecting said aerosol particles to shear forces and internal particle pressures for converting the aerosol particles into a gas-phase fluid; and (e) withdrawing said gas-phase fluid thus created while retaining any remaining aerosol particles therein, wherein lighter aerosol particles are continuously converted to a gas-phase fluid while heavier aerosol particles are progressively diminished in size as the aerosol particles are subjected to said shear forces and differential particle pressures.

26. The method of preparing a gas-phase fluid according to claim 25, wherein each flow pressure increasing duct includes a first delivery inlet positioned at the upstream end of said flow pressure increasing duct and at least one inlet positioned on the periphery of said duct at the upstream end of said flow pressure increasing duct, wherein step (b) is performed by passing said fluid through said first delivery inlet and by passing air through said at least one inlet positioned on the periphery of said flow pressure increasing duct.

27. The method of preparing a gas-phase fluid according to claim 26, wherein step (e) includes spinning said remaining aerosol particles to cause said aerosol particles to recondense as a liquid upon a separating surface.

28. The method of preparing a gas-phase fluid according to claim 27, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

29. The method of preparing a gas-phase fluid according to claim 26, wherein said flow path further includes a venturi chamber, and said method further comprises:

(f) following step (d), continuously delivering said gas-phase fluid to said venturi chamber and simultaneously mixing said gas-phase fluid with air in said venturi chamber.

30. The method of preparing a gas-phase fluid according to claim 29, wherein said venturi chamber includes a plurality of openings circumferentially positioned about a throat of said venturi chamber, and an air inlet, wherein step (f) is performed by continuously receiving said gas-phase fluid through said plurality of openings and by receiving air through said venturi chamber air inlet.

31. The method of preparing a gas-phase fluid according to claim 30, wherein step (e) includes spinning said remaining aerosol particles to cause said aerosol particles to recondense as a liquid upon a separating surface.

32. The method of preparing a gas-phase fluid according to claim 31, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

33. The method of preparing a gas-phase fluid according to claim 25, wherein each flow pressure increasing duct includes a first delivery inlet positioned at the upstream end of said flow pressure increasing duct and further includes at least one inlet positioned on the periphery of said duct at the upstream end of said flow pressure increasing duct, a constriction portion downstream of said flow pressure increasing duct, and an acceleration portion having at least one inlet positioned on a periphery of said accelerator portion, wherein:

step (b) is performed by passing said fluid through said first delivery inlet and by passing air through said at least one inlet positioned on the periphery of said flow pressure increasing duct, step (c) is performed by passing said aerosol particles through said constriction portion, and step (d) is performed by passing air through said at least one inlet positioned on the periphery of said accelerator portion.

34. The method of preparing a gas-phase fluid according to claim 33, wherein step (e) includes spinning said remaining aerosol particles to cause said aerosol particles to recondense as a liquid upon a separating surface.

35. The method of preparing a gas-phase fluid according to claim 34, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

36. The method of preparing a gas-phase fluid according to claim 33, wherein said flow path further includes a venturi chamber, and said method further comprises:

(f) following step (d), continuously delivering said gas-phase fluid to said venturi chamber and simultaneously mixing said gas-phase fluid with air in said venturi chamber.

37. The method of preparing a gas-phase fluid according to claim 36, wherein said venturi chamber includes a plurality of openings circumferentially positioned about a throat of said venturi chamber, and an air inlet, wherein step (f) is performed by continuously receiving said gas-phase fluid through said plurality of openings and by receiving air through said venturi chamber air inlet.

38. The method of preparing a gas-phase fluid according to claim 37, wherein step (e) includes spinning said remaining aerosol particles to cause said aerosol particles to recondense as a liquid upon a separating surface.

39. The method of preparing a gas-phase fluid according to claim 38, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

40. The method of preparing a gas-phase fluid according to claim 25, wherein each flow pressure increasing duct flow includes a first delivery inlet positioned at the upstream end of said flow pressure increasing duct and at least one inlet positioned on a periphery of said flow pressure increasing duct at the upstream end of said flow pressure increasing duct, a first constriction portion downstream of said flow pressure increasing duct, and a first accelerator portion having at least one inlet positioned on a periphery thereof downstream of said constriction portion, and at least one arrangement of a second constriction portion and a second accelerator portion having at least one inlet positioned on a periphery thereof, said second accelerator downstream of said second constriction portion, said at least one arrangement downstream of said first accelerator portion wherein:

step (b) is performed by passing said fluid through said first delivery inlet and passing air through said at least one inlet positioned on a periphery of said flow pressure increasing duct;

step (c) is performed by passing said aerosol particles through said first constriction portion;

step (d) is performed by passing air through said at least one inlet positioned on the periphery of said accelerator portion, and steps (c) and (d) are repeated in said at least one arrangement, whereby the heavier aerosol particles are subjected to prolonged turbulence and shear forces.

41. The method of preparing a gas-phase fluid according to claim 40, wherein step (e) includes spinning said remaining aerosol particles to cause said aerosol particles to recondense as a liquid upon a separating surface.

42. The method of preparing a gas-phase fluid according to claim 41, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

43. The method of preparing a gas-phase fluid according to claim 40, wherein said flow path further includes a venturi chamber, and said method further comprises:

(f) following step (d), continuously delivering said gas-phase fluid to said venturi chamber and simultaneously mixing said gas-phase fluid with air in said venturi chamber.

44. The method of preparing a gas-phase fluid according to claim 43, wherein said venturi chamber includes a plurality of openings circumferentially positioned about a throat of said venturi chamber, and an air inlet, wherein step (f) is performed by continuously receiving said gas-phase fluid through said plurality of openings and by receiving air through said venturi chamber air inlet.

45. The method of preparing a gas-phase fluid according to claim 44, wherein step (e) includes spinning said remaining aerosol particles to cause said aerosol particles to recondense as a liquid upon a separating surface.

46. The method of preparing a gas-phase fluid according to claim 45, wherein said flow pressure increasing duct includes a second delivery inlet positioned at the upstream end of said flow pressure increasing duct, and wherein step (a) further includes combining said liquid with the fluid being introduced into said flow path, said liquid being introduced into said second delivery inlet, whereby said liquid is combined with said fluid being introduced into said flow path for further shearing.

47. The method of preparing a gas-phase fluid according to claim 25, wherein step (e) includes spinning said remaining aerosol particles to cause said aerosol particles to recondense as a liquid upon a separating surface.

48. The method of preparing a gas-phase fluid according to claim 47, wherein step (a) further includes combining said liquid with the fluid being introduced into said flow path, said liquid being introduced into said flow pressure increasing duct, whereby said liquid is combined with said fluid being introduced into said flow path for further shearing.

49. A method of preparing a gas-phase fuel-air mixture for an internal combustion engine, comprising the steps of:

providing a plurality of fuel-air mixture flow paths;

selectively controlling the flow of fuel and air along said fuel-air mixture flow paths;

vortically spinning said fuel in a flow pressure increasing portion of each of said fuel-air mixture flow paths for creating vortically spinning columns of fuel and air;

continuously delivering air tangentially into each of said vortically spinning columns of fuel and air;

turbulently and vortically commingling said air delivered into each of said vortically spinning columns of fuel and air for vortically shearing said fuel into a substantially vaporized fuel-air mixture;

vortically homogenizing and mixing said fuel-air mixture and causing unvaporized fuel to impinge upon a separating surface;

returning said liquid to the beginning of said flow pressure increasing portion of each of said fuel-air mixture flow paths for vaporizing said liquid; and exiting the vaporized fuel-air mixture as a gas-phase fuel-air mixture for use in an internal combustion engine, wherein the step of vortically spinning the fuel is carried out in a plurality of consecutive portions of each of said fuel vaporizing flow paths for creating a plurality of vortically spinning columns of fuel and air.

50. A cyclone vortex system for vaporizing a fluid into a gas-phase fluid, comprising:

a fluid vaporizing cylindrical vortex configuration having at least one vortex unit with a chamber, an input to said chamber and an output from said chamber for allowing a fluid to flew between said input and said output, wherein said input includes a flow pressure increasing duct at one end of said vortex configuration, and said output includes a constricted opening located at another end of said vortex configuration, wherein said flow pressure increasing duct includes a first fluid delivery inlet positioned at an upstream end of said flow pressure increasing duct and at least one air inlet positioned on the periphery of said duct at the upstream end of said flow pressure increasing duct, and wherein said fluid vaporizing cylindrical vortex configuration has at least one aperture for inputting air tangentially to the flow of fluid between said input and said output for vaporizing said fluid into a gas-phase fluid-air mixture.

51. The cyclone vortex system according to claim 50, further comprising:

a centrifuge housing including, an intake opening in fluid communication with said chamber output, a centrifuge chamber for cyclonically separating non-vaporized fluid from vaporized fluid, a central barrel located within said centrifuge chamber having an input for receiving said vaporized fluid and an output for exiting said vaporized fluid from said centrifuge housing, and a return opening for returning said non-vaporized fluid to a second delivery inlet positioned at an upstream end of said flow pressure increasing duct.

52. The cyclone vortex system according to claim 50, further comprising:

a throttle-body venturi housing including, a venturi chamber with a throat, a main air intake opening, a throttle plate positioned in said throat for controlling the quantity of air passing through said venturi chamber, a discharge opening, a through hole located between said main air intake opening and said throttle plate for providing air from said main air intake opening to said fluid vaporizing cylindrical vortex configurations, and at least one passageway located between said throttle plate and said discharge opening in fluid communication with said chamber output, wherein said discharge opening is for discharging the flow of fluid and air from said venturi chamber.

53. The cyclone vortex system according to claim 52, further comprising:

a centrifuge housing including, an intake opening in fluid communication with said discharge opening, a centrifuge chamber for cyclonically separating non-vaporized fluid from vaporized fluid, a central barrel located within said centrifuge chamber having an input for receiving said vaporized fluid and an output for exiting said vaporized fluid from said centrifuge housing, and a return opening for returning said non-vaporized fluid to a second delivery inlet positioned at an upstream end of said flow pressure increasing duct.

54. The cyclone vortex system according to claim 53, further comprising:

said at least one passageway including a plurality of openings an fluid communication with said chamber output, said openings being circumferentially distributed about said throttle-body venturi housing.

55. The cyclone vortex system according to claim 54, wherein said throttle-body venturi housing includes a venturi-shaped portion positioned downstream of said throttle plate, said venturi-shaped portion having at least one opening in fluid communication with said at least one passageway.

56. The cyclone vortex system according to claim 54, wherein said throttle-body venturi housing includes a venturi-shaped portion positioned downstream of said throttle plate, said venturi-shaped portion having a plurality of openings in fluid communication with said passageway, said openings being circumferentially distributed about said venturi-shaped portion.

57. The cyclone vortex system according to claim 50, wherein said fluid vaporizing cylindrical vortex configuration has a tiered plurality of vortex units, each vortex unit having a vortex chamber for vaporizing a fluid, wherein the vortex chamber in each vortex unit is joined by a constricted bore, with the lowermost vortex unit of said tiered plurality of tiered vortex units forming said flow pressure increasing duct at an end of said lowermost vortex unit opposite the end with a constricted bore therein, wherein each vortex unit other than said lowermost vortex unit includes at least one aperture, and wherein the uppermost vortex unit of said tiered plurality of vortex units includes said output.

58. The cyclone vortex system according to claim 57, wherein said flow pressure increasing duct includes a first delivery inlet positioned at an upstream end of said flow pressure increasing duct and at least one inlet positioned on the periphery of said duct at the upstream end of said flow pressure increasing duct.

59. The cyclone vortex system according to claim 58, further comprising:

a centrifuge housing including, an intake opening in fluid communication with said chamber output, a centrifuge chamber for cyclonically separating non-vaporized fluid from vaporized fluid, a central barrel located within said centrifuge chamber having an input for receiving said vaporized fluid and an output for exiting said vaporized fluid from said centrifuge housing, and a return opening for returning said non-vaporized fluid to a second delivery inlet positioned at an upstream end of said flow pressure increasing duct.

60. The cyclone vortex system according to claim 58, further comprising:

a throttle-body venturi housing including, a venturi chamber with a throat, a main air intake opening, a throttle plate positioned in said throat for controlling the quantity of air passing through said venturi chamber, a discharge opening, a through hole located between said main air intake opening and said throttle plate for providing air from said main air intake opening to said fluid vaporizing cylindrical vortex configurations, and at least one passageway located between said throttle plate and said discharge opening in fluid communication with said chamber output, wherein said discharge opening is for discharging the flow of fluid and air from said venturi chamber.

61. The cyclone vortex system according to claim 60, further comprising:

a centrifuge housing including, an intake opening in fluid communication with said discharge opening, a centrifuge chamber for cyclonically separating non-vaporized fluid from vaporized fluid, a central barrel located within said centrifuge chamber having an input for receiving said vaporized fluid and an output for exiting said vaporized fluid from said centrifuge housing, and a return opening for returning said non-vaporized fluid to a second delivery inlet positioned at an upstream end of said flow pressure increasing duct.

62. The cyclone vortex system according to claim 60, further comprising:

said at least one passageway including a plurality of openings in fluid communication with said chamber output, said openings being circumferentially distributed about said throttle-body venturi housing.

63. The cyclone vortex system according to claim 62, wherein said throttle-body venturi housing includes a venturi-shaped portion positioned downstream of said throttle plate, said venturi-shaped portion having at least one opening in fluid communication with said at least one passageway.

64. The cyclone vortex system according to claim 62, wherein said throttle-body venturi housing includes a venturi-shaped portion positioned downstream of said throttle plate, said venturi-shaped portion having a plurality of openings in fluid communication with said passageway, said openings being circumferentially distributed about said venturi-shaped portion.

65. A cyclone vortex system for vaporizing a fluid into a gas-phase fluid, comprising:

a plurality of fluid vaporizing cylindrical vortex configurations, each vortex configuration having at least one vortex unit with a chamber, an input to said chamber and an output from said chamber for allowing a fluid to flow between said input and said output, wherein each input includes a flow pressure increasing duct at one end of said vortex configuration, and each output includes a constricted opening located at another end of each vortex configuration, wherein each flow pressure increasing duct includes a first fluid delivery inlet positioned at an upstream end of said flow pressure increasing duct and at least one air inlet positioned on the periphery of said duct at the upstream end of said flow pressure increasing duct, and wherein each fluid vaporizing cylindrical vortex configuration has at least one aperture for inputting air tangentially to the flow of fluid between Said input and said output for vaporizing said fluid into a gas-phase fluid-air mixture.

66. The cyclone vortex system according to claim 65, further comprising:

a centrifuge housing including, an intake opening in fluid communication with each chamber output, a centrifuge chamber for cyclonically separating non-vaporized fluid from vaporized fluid, a central barrel located within said centrifuge chamber having an input for receiving said vaporized fluid and an output for exiting said vaporized fluid from said centrifuge housing, and a return opening for returning said non-vaporized fluid to a second delivery inlet positioned at an upstream end of said flow pressure increasing duct.

67. The cyclone vortex system according to claim 65, further comprising:

a throttle-body venturi housing including, a venturi chamber with a throat, a main air intake opening, a throttle plate positioned in said throat for controlling the quantity of air passing through said venturi chamber, a discharge opening, a through hole located between said main air intake opening and said throttle plate for providing air from said main air intake opening to said fluid vaporizing cylindrical vortex configurations, and at least one passageway located between said throttle plate and said discharge opening in fluid communication with each chamber output, wherein said discharge opening is for discharging the flow of fluid and air from said venturi chamber.

68. The cyclone vortex system according to claim 67, further comprising:

a centrifuge housing including, an intake opening in fluid communication with said discharge opening, a centrifuge chamber for cyclonically separating non-vaporized fluid from vaporized fluid, a central barrel located within said centrifuge chamber having an input for receiving said vaporized fluid and an output for exiting said vaporized fluid from said centrifuge housing, and a return opening for returning said non-vaporized fluid to a second delivery inlet positioned at an upstream end of said flow pressure increasing duct.

69. The cyclone vortex system according to claim 68, further comprising:

said at least one passageway including a plurality of openings in fluid communication with each chamber output, said openings being circumferentially distributed about said throttle-body venturi housing.

70. The cyclone vortex system according to claim 69, wherein said throttle-body venturi housing includes a venturi-shaped portion positioned downstream of said throttle plate, said venturi-shaped portion having at least one opening in fluid communication with said at least one passageway.

71. The cyclone vortex system according to claim 69, wherein said throttle-body venturi housing includes a venturi-shaped portion positioned downstream of said throttle plate, said venturi-shaped portion having a plurality of openings in fluid communication with said passageway, said openings being circumferentially distributed about said venturi-shaped portion.

72. The cyclone vortex system according to claim 65, wherein each fluid vaporizing cylindrical vortex configuration has a tiered plurality of vortex units, each vortex unit having a vortex chamber for vaporizing a fluid, wherein the vortex chamber in each vortex unit is joined by a constricted bore, with the lowermost vortex unit of said tiered plurality of tiered vortex units forming said flow pressure increasing duct at an end of said lowermost vortex unit opposite the end with a constricted bore therein, wherein each vortex unit other than said lowermost vortex unit includes at least one aperture, and wherein the uppermost vortex unit of said tiered plurality of vortex units includes said output.

73. The cyclone vortex system for vaporizing a fluid into a gas-phase fluid according to claim 72, wherein said flow pressure increasing duct includes a first delivery inlet positioned at an upstream end of each flow pressure increasing duct and at least one inlet positioned on the periphery of said duct at the upstream end of said flow pressure increasing duct.

74. The cyclone vortex system according to claim 73, further comprising:

a centrifuge housing including, an intake opening in fluid communication with each chamber output, a centrifuge chamber for cyclonically separating non-vaporized fluid from vaporized fluid, a central barrel located within said centrifuge chamber having an input for receiving said vaporized fluid and an output for exiting said vaporized fluid from said centrifuge housing, and a return opening for returning said non-vaporized fluid to a second delivery inlet positioned at an upstream end of said flow pressure increasing duct.

75. The cyclone vortex system according to claim 73, further comprising:

a throttle-body venturi housing including, a venturi chamber with a throat, a main air intake opening, a throttle plate positioned in said throat for controlling the quantity of air passing through said venturi chamber, a discharge opening, a through hole located between said main air intake opening and said throttle plate for providing air from said main air intake opening to said fluid vaporizing cylindrical vortex configurations, and at least one passageway located between said throttle plate and said discharge opening in fluid communication with each chamber output, wherein said discharge opening is for discharging the flow of fluid and air from said venturi chamber.

76. The cyclone vortex system according to claim 75, further comprising:

a centrifuge housing including, an intake opening in fluid communication with said discharge opening, a centrifuge chamber for cyclonically separating non-vaporized fluid from vaporized fluid, a central barrel located within said centrifuge chamber having an input for receiving said vaporized fluid and an output for exiting said vaporized fluid from said centrifuge housing, and a return opening for returning said non-vaporized fluid to a second delivery inlet positioned at an upstream end of said flow pressure increasing duct.

77. The cyclone vortex system according to claim 75, further comprising:

said at least one passageway including a plurality of openings in fluid communication with said chamber output, said openings being circumferentially distributed about said throttle-body venturi housing.

78. The cyclone vortex system according to claim 77, wherein said throttle-body venturi housing includes a venturi-shaped portion positioned downstream of said throttle plate, said venturi-shaped portion having at least one opening in fluid communication with said at least one passageway.

79. The cyclone vortex system according to claim 77, wherein said throttle-body venturi housing includes a venturi-shaped portion positioned downstream of said throttle plate, said venturi-shaped portion having a plurality of openings in fluid communication with said passageway, said openings being circumferentially distributed about said venturi-shaped portion.

* * * * *